US008342496B2

(12) United States Patent
Toda et al.

(10) Patent No.: US 8,342,496 B2
(45) Date of Patent: Jan. 1, 2013

(54) PRINTING SYSTEM, PRINTING APPARATUS, JOB PROCESSING METHOD, STORAGE MEDIUM, AND PROGRAM

(75) Inventors: Masayuki Toda, Yokohama (JP); Kiyoshi Tokashiki, Yokohama (JP); Kazuhiko Ushiyama, Tokyo (JP)

(73) Assignee: Canon Kabushiki Kaisha (JP)

( * ) Notice: Subject to any disclaimer, the term of this patent is extended or adjusted under 35 U.S.C. 154(b) by 1162 days.

(21) Appl. No.: 12/194,242

(22) Filed: Aug. 19, 2008

(65) Prior Publication Data

US 2009/0055012 A1 Feb. 26, 2009

(30) Foreign Application Priority Data

Aug. 20, 2007 (JP) ..... 2007-213843

(51) Int. Cl.
*B31F 1/00* (2006.01)

(52) U.S. Cl. ..... 270/37; 270/32; 270/45; 270/51; 270/52.18; 270/58.07; 270/58.08

(58) Field of Classification Search ..... 270/32, 270/37, 45, 51, 52.18, 58.07, 58.08; 493/406, 493/442, 454

See application file for complete search history.

(56) References Cited

U.S. PATENT DOCUMENTS

| | | | | |
|---|---|---|---|---|
| 2,088,904 | A | 8/1937 | Grammer | |
| 4,724,460 | A * | 2/1988 | Shinyashiki | 399/14 |
| 4,891,681 | A | 1/1990 | Fiske et al. | |
| 5,398,289 | A | 3/1995 | Rourke et al. | |
| 5,508,798 | A | 4/1996 | Yamada | |
| 6,308,041 | B2 * | 10/2001 | Shiramura | 399/410 |
| 6,381,442 | B1 * | 4/2002 | Okitsu et al. | 399/405 |
| 7,281,707 | B2 * | 10/2007 | Moriyama et al. | 270/58.04 |
| 7,285,084 | B2 | 10/2007 | Fujimoto et al. | |
| 7,325,799 | B2 * | 2/2008 | Watkiss | 270/39.08 |
| 7,594,645 | B2 | 9/2009 | Suzuki et al. | |
| 7,607,650 | B2 * | 10/2009 | Oikawa et al. | 270/58.07 |
| 7,660,556 | B2 | 2/2010 | Saitsu et al. | |

(Continued)

FOREIGN PATENT DOCUMENTS

JP 2004-066582 A 3/2004

(Continued)

OTHER PUBLICATIONS

Specification and drawings of related co-pending U.S. Appl. No. 12/194,321, filed Aug. 19, 2008. Masayuki Toda et al.; "Printing system, job processing method, storage medium, program product, and printing apparatus", pp. 1-97; 25 drawing sheets.

(Continued)

*Primary Examiner* — Leslie A Nicholson, III

(74) *Attorney, Agent, or Firm* — Rossi, Kimms & McDowell LLP

(57) ABSTRACT

A printing system which is capable of performing square back processing and has a mechanism that makes it possible to prevent occurrence of a new trouble of inadvertently creating a saddle-stitched brochure defective in appearance and/or stackability, which is unexpected by an operator. A printing apparatus receives plural jobs including a saddle-stitch job for creating a saddle-stitched brochure of a predetermined kind. In the saddle-stitch job, saddle-stitch processing and square back processing are carried out. The square back processing is performed by a saddle-stitching machine. The saddle-stitching machine forms a flat surface on the back of a saddle-stitched brochure. A controller permits or inhibits creating the saddle-stitched brochure of the predetermined kind for a job based on whether the job meets a predetermined condition.

16 Claims, 22 Drawing Sheets

U.S. PATENT DOCUMENTS

| | | | | |
|---|---|---|---|---|
| 7,891,928 | B2 | 2/2011 | Harada | |
| 7,907,887 | B2 | 3/2011 | Asai et al. | |
| 7,976,450 | B2 | 7/2011 | Endo | |
| 8,109,495 | B2 | 2/2012 | Kikkawa et al. | |
| 2005/0008460 | A1* | 1/2005 | Watkiss | 412/9 |
| 2006/0153612 | A1 | 7/2006 | Saitsu et al. | |
| 2006/0263174 | A1* | 11/2006 | Oikawa et al. | 412/33 |
| 2007/0035081 | A1 | 2/2007 | Kaneko et al. | |
| 2007/0045926 | A1* | 3/2007 | Fukatsu et al. | 270/58.07 |
| 2007/0120310 | A1 | 5/2007 | Awano | |
| 2009/0290170 | A1 | 11/2009 | Matsumura | |

FOREIGN PATENT DOCUMENTS

| | | | |
|---|---|---|---|
| JP | 2004-210436 | A | 7/2004 |
| JP | 2004-310746 | A | 11/2004 |
| JP | 2004-310747 | A | 11/2004 |
| JP | 2005-321757 | A | 11/2005 |
| JP | 2006-159894 | A | 6/2006 |
| JP | 2006-285709 | A | 10/2006 |
| JP | 2006-321622 | A | 11/2006 |
| JP | 2007-147815 | A | 6/2007 |

OTHER PUBLICATIONS

Japanese Office Action corresponding to JP 2007-213843, dated Dec. 22, 2011.

Office Action issued in counterpart Japanese Patent Application 2007-213843 dated Apr. 3, 2012.

* cited by examiner

FIG. 21

2100

| RULE INFORMATION AS TO WHETHER TO PERMIT OR INHIBIT SQUARE BACK PROCESSING<br>(Z: NUMBER OF SHEETS REQUIRED TO BE PRINTED AS ONE SET FOR A JOB TO BE PROCESSED) |
|---|
| [RULE 1]<br>CASE OF "Z < 5" (CASE 1): INHIBIT CREATION OF SADDLE-STITCHED BROCHURE WITH SQUARE BACK.<br>HOWEVER,PERMIT CREATION OF SADDLE-STITCHED BROCHURE WITHOUT SQUARE BACK. |
| [RULE 2]<br>CASE OF "5 ≤ Z ≤ 15" (CASE 2): PERMIT CREATION OF SADDLE-STITCHED BROCHURE WITH SQUARE BACK.<br>ALSO PERMIT CREATION OF SADDLE-STITCHED BROCHURE WITHOUT SQUARE BACK. |
| [RULE 3]<br>CASE OF "15 < Z ≤ 20" (CASE 3): INHIBIT CREATION OF SADDLE-STITCHED BROCHURE WITHOUT SQUARE BACK.<br>HOWEVER, PERMIT CREATION OF SADDLE-STITCHED BROCHURE WITH SQUARE BACK. |
| [RULE 4]<br>CASE OF "20 < Z" (CASE 4): INHIBIT CREATION OF SADDLE-STITCHED BROCHURE WITHOUT SQUARE BACK.<br>ALSO INHIBIT CREATION OF SADDLE-STITCHED BROCHURE WITH SQUARE BACK. |

FIG. 22

2200

| SHEET TYPE (MEDIA TYPE) | RULE INFORMATION AS TO WHETHER TO PERMIT OR INHIBIT SQUARE BACK PROCESSING (Z: NUMBER OF SHEETS REQUIRED TO BE PRINTED AS ONE SET FOR A JOB TO BE PROCESSED) |
|---|---|
| FIRST MEDIA TYPE (ORDINARY PAPER, RECYCLE PAPER) | [RULE 1-1]CASE OF "Z < 5" (CASE 1-1): INHIBIT CREATION OF SADDLE-STITCHED BROCHURE WITH SQUARE BACK. HOWEVER, PERMIT CREATION OF SADDLE-STITCHED BROCHURE WITHOUT SQUARE BACK. |
| | [RULE 1-2]CASE OF "5 ≤ Z ≤ 15" (CASE 1-2): PERMIT CREATION OF SADDLE-STITCHED BROCHURE WITH SQUARE BACK. ALSO PERMIT CREATION OF SADDLE-STITCHED BROCHURE WITHOUT SQUARE BACK. |
| | [RULE 1-3]CASE OF "15 < Z ≤ 20" (CASE 1-3): INHIBIT CREATION OF SADDLE-STITCHED BROCHURE WITHOUT SQUARE BACK. HOWEVER, PERMIT CREATION OF SADDLE-STITCHED BROCHURE WITH SQUARE BACK. |
| | [RULE 1-4]CASE OF "20 < Z" (CASE 1-4): INHIBIT CREATION OF SADDLE-STITCHED BROCHURE WITHOUT SQUARE BACK. ALSO INHIBIT CREATION OF SADDLE-STITCHED BROCHURE WITH SQUARE BACK. |
| SECOND MEDIA TYPE (THICK PAPER) | [RULE 2-1]CASE OF "Z < 3" (CASE 2-1): INHIBIT CREATION OF SADDLE-STITCHED BROCHURE WITH SQUARE BACK. HOWEVER, PERMIT CREATION OF SADDLE-STITCHED BROCHURE WITHOUT SQUARE BACK. |
| | [RULE 2-2]CASE OF "3 ≤ Z ≤ 12" (CASE 2-2): PERMIT CREATION OF SADDLE-STITCHED BROCHURE WITH SQUARE BACK. ALSO PERMIT CREATION OF SADDLE-STITCHED BROCHURE WITHOUT SQUARE BACK. |
| | [RULE 2-3]CASE OF "12 < Z ≤ 18" (CASE 2-3): INHIBIT CREATION OF SADDLE-STITCHED BROCHURE WITHOUT SQUARE BACK. HOWEVER, PERMIT CREATION OF SADDLE-STITCHED BROCHURE WITH SQUARE BACK. |
| | [RULE 2-4]CASE OF "18 < Z" (CASE 2-4): INHIBIT CREATION OF SADDLE-STITCHED BROCHURE WITHOUT SQUARE BACK. ALSO INHIBIT CREATION OF SADDLE-STITCHED BROCHURE WITH SQUARE BACK. |
| • | • |
| • | • |
| MEDIA TYPE N | • |
| | • |
| | • |

PRINTING SYSTEM, PRINTING APPARATUS, JOB PROCESSING METHOD, STORAGE MEDIUM, AND PROGRAM

BACKGROUND OF THE INVENTION

1. Field of the Invention

The present invention relates to a printing system and a printing apparatus which are configured to be capable of performing square back processing, a job processing method, a storage medium, and a program.

2. Description of the Related Art

Recently, there has been proposed a POD (Print On Demand) printing system using an electrophotographic printing apparatus or an inkjet printing apparatus (see Japanese Patent Laid-Open Publications No. 2004-310746 and No. 2004-310747). The POD printing system of this type is advantageous in that block copy preparation and other complicated operations required by an offset plate making printer can be dispensed with.

On the other hand, in the POD market, there can be demands for creating various forms of printouts. For example, there can be a demand for creating a printout subjected to saddle-stitching bookbinding (hereinafter also referred to "saddle-stitched brochure") having a special form obtained e.g. by performing a squaring process for making square the back of a saddle-stitched brochure (such that a square back is formed). To perform a squaring process such that the back of a saddle-stitched brochure is flattened (i.e. roundness of the back is suppressed) is referred to as square back (or square hold) processing. There has been proposed a technique for performing the square back processing by a special post-processing apparatus (see Japanese Patent Laid-Open Publication No. 2006-159894).

However, the above-mentioned post-processing apparatus capable of performing the square back processing is configured to be usable as an offline finisher provided independently of a printing apparatus. For this reason, an operator (or a user) is required to carry out work for taking out a printout after execution of printing by the printing apparatus, and manually setting the printout in the post-processing apparatus.

In view of this situation, it can be expected that the POD market or the like will demand a printing system in which a post-processing apparatus capable of creating a saddle-stitched brochure subjected to square back processing can be made use of as an inline finisher connectable to a printing apparatus, in the future. Further, it can be expected that there will be a demand for a printing system which is capable of carrying out an entire process from print processing executed by a printing apparatus to creation of a saddle-stitched brochure subjected to square back processing, in the future.

In a case where a printing system is configured to be capable of meeting the above-mentioned demands, it is preferable to prevent occurrence of a trouble due to the fact that the system is configured to be capable of performing the process from print processing to square back processing.

However, the present situation is not such that the above-mentioned possible problem of occurrence of the trouble is tackled to provide a countermeasure for making such a printing system commercially available/practical, and hence, no research has been made on a mechanism for preventing occurrence of troubles that can occur in the following situations:

For example, when saddle stitching without square back processing is designated in a job including printing of a large number of sheets, a created printout is formed to have an arcuate bulge in a portion of a sheet bundle thereof extending from the back of the sheet bundle toward an opposite end (fore edge) of the same, which can cause collapse of a stack of printouts. Further, in this case, the printout is not attractive in finished quality (appearance).

On the other hand, when saddle stitching including square back processing is designated in a job including printing of a small number of sheets, the back of a created printout is crushed or protruded when printouts are stacked, which can cause collapse of a stack of printouts.

As described above, when the printing system is constructed to be capable of performing square back processing, there is a possibility of a new trouble of inadvertently creating a saddle-stitched brochure defective in appearance and/or stackability, which is unexpected by an operator.

SUMMARY OF THE INVENTION

The present invention provides a printing system which is capable of performing square back processing and has a mechanism that makes it possible to prevent occurrence of a new trouble of inadvertently creating a saddle-stitched brochure defective in appearance and/or stackability, which is unexpected by an operator.

In a first aspect of the present invention, there is provided a printing system comprising a receiving unit adapted to receive plural jobs including a predetermined job, the predetermined job being a job for creating a saddle-stitched brochure of a predetermined kind, in which saddle-stitch processing and square back processing are carried out, the square back processing being performed by a working unit, the working unit being a unit adapted to form a flat surface on a back of one set of sheets subjected to the saddle-stitch processing, the saddle-stitch processing being performed by a saddle stitching unit, the saddle stitching unit being adapted to perform the saddle-stitch processing on one set of sheets subjected to print processing by a printing unit, and a control unit adapted to permit or inhibit creating the saddle-stitched brochure of the predetermined kind for a job based on whether the job meets a predetermined condition.

In a second aspect of the present invention, there is provided a job processing method comprising: receiving plural jobs including a predetermined job, the predetermined job being a job for creating a saddle-stitched brochure of a predetermined kind, in which saddle-stitch processing and square back processing are carried out, the square back processing being performed by a working unit, the working unit being a unit adapted to form a flat surface on a back of one set of sheets subjected to the saddle-stitch processing, the saddle-stitch processing being performed by a saddle stitching unit, and the saddle stitching unit being adapted to perform the saddle-stitch processing on one set of sheets subjected to print processing by a printing unit, and permitting or inhibiting creating the saddle-stitched brochure of the predetermined kind for a job based on whether the job meets a predetermined condition.

In a third aspect of the present invention, there is provided a computer-readable medium adapted to store a program for causing a computer to execute the job processing method.

In a fourth aspect of the present invention, there is provided a program for causing computer to execute the job processing method, the program being stored in computer-readable medium.

With the configuration of the present invention, it is possible to prevent the printing system capable of performing square back processing from causing a new trouble of inadvertently creating a saddle-stitched brochure defective in appearance and/or stackability, which is unexpected by an operator.

The features and advantages of the invention will become more apparent from the following detailed description taken in conjunction with the accompanying drawings.

BRIEF DESCRIPTION OF THE DRAWINGS

FIG. 21 is a diagram showing an example of a management table describing rule information as to whether or not execution of square back processing is permitted.

FIG. 22 is a diagram showing an example of a management table describing rule information as to whether or not execution of square back processing is permitted, on a sheet type-by-sheet type basis.

DETAILED DESCRIPTION OF THE EMBODIMENTS

The present invention will now be described in detail with reference to the drawings showing embodiments thereof.

Figure 1:
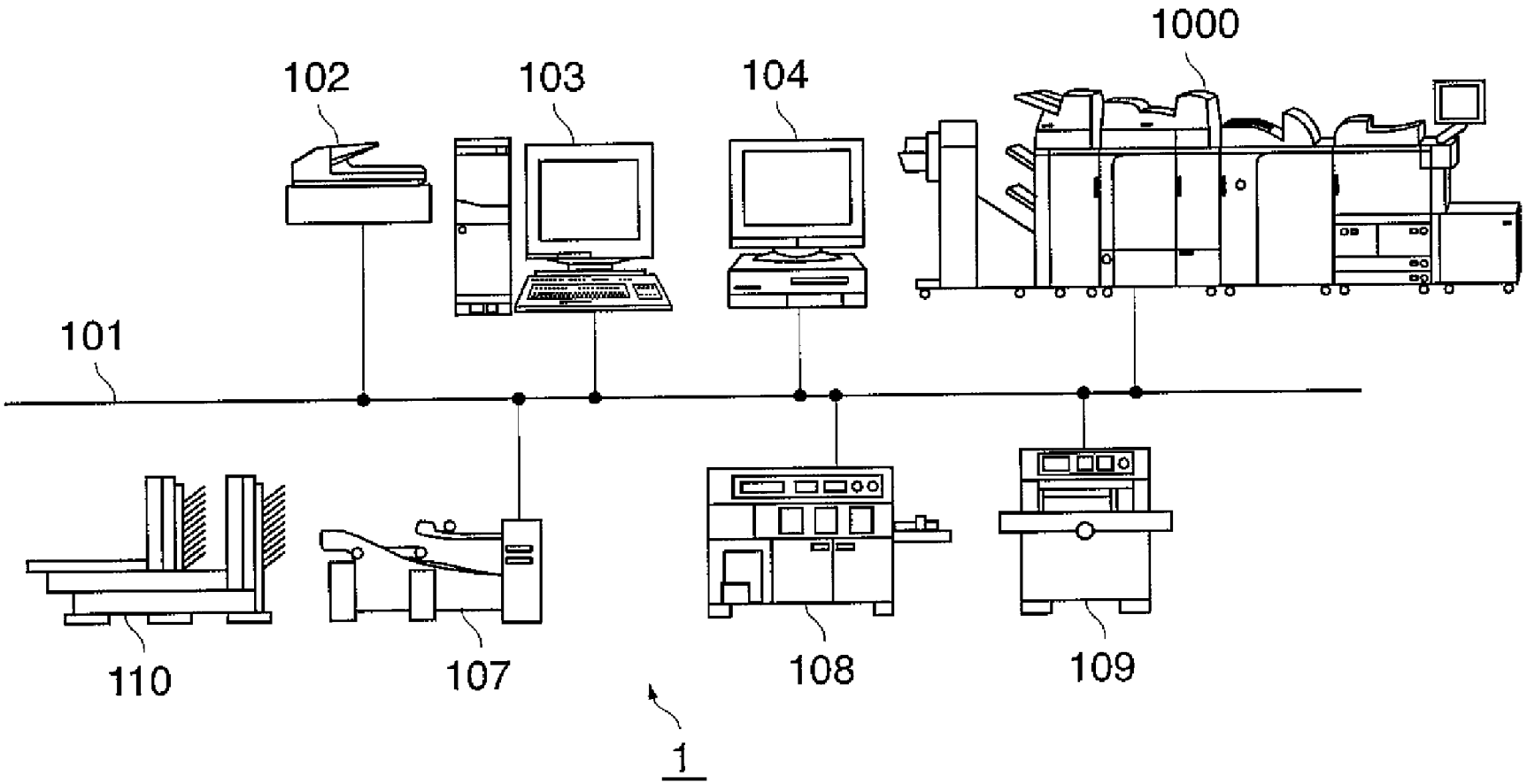
FIG. 1 is a view of a POD system suitable for a printing system according to an embodiment of the present invention.

FIG. 1 is a view of a POD system suitable for a printing system according to an embodiment of the present invention.

The POD system 1 includes the printing system 1000, a scanner 102, a server computer (PC) 103, and a client computer (PC) 104, which are interconnected via a network 101. Further, the POD system 1 includes a sheet folding machine 107, a trimming machine 109, a saddle stitching machine 110, and a casing-in machine 108.

The PC 103 manages data transmission and reception to and from various apparatuses connected to the network 101. The PC 104 transmits image data to the printing system 1000 or the PC 103 via the network 101. The sheet folding machine 107 performs folding of sheets printed by the printing system 1000. The casing-in machine 108 performs case binding of sheets printed by the printing system 1000. The trimming machine 109 performs rimming of each sheet bundle formed by sheets printed by the printing system 1000. The saddle stitching machine 110 performs saddle-stitch processing on each sheet bundle formed by sheets printed by the printing system 1000.

In the case of using the sheet folding machine 107, the casing-in machine 108, the trimming machine 109, or the saddle stitching machine 110, an operator (or a user) takes out a bundle of printed sheets from the printing system 1000 and sets the same in the machine so as to cause the machine to perform the associated processing.

The machines and apparatuses included in the POD system 1 are connected to the network 101 except the saddle stitching machine 110 such that they can perform data communication with each other.

Next, the configuration of the printing system 1000 will be described with reference to FIGS. 2 and 3.

Figure 2:
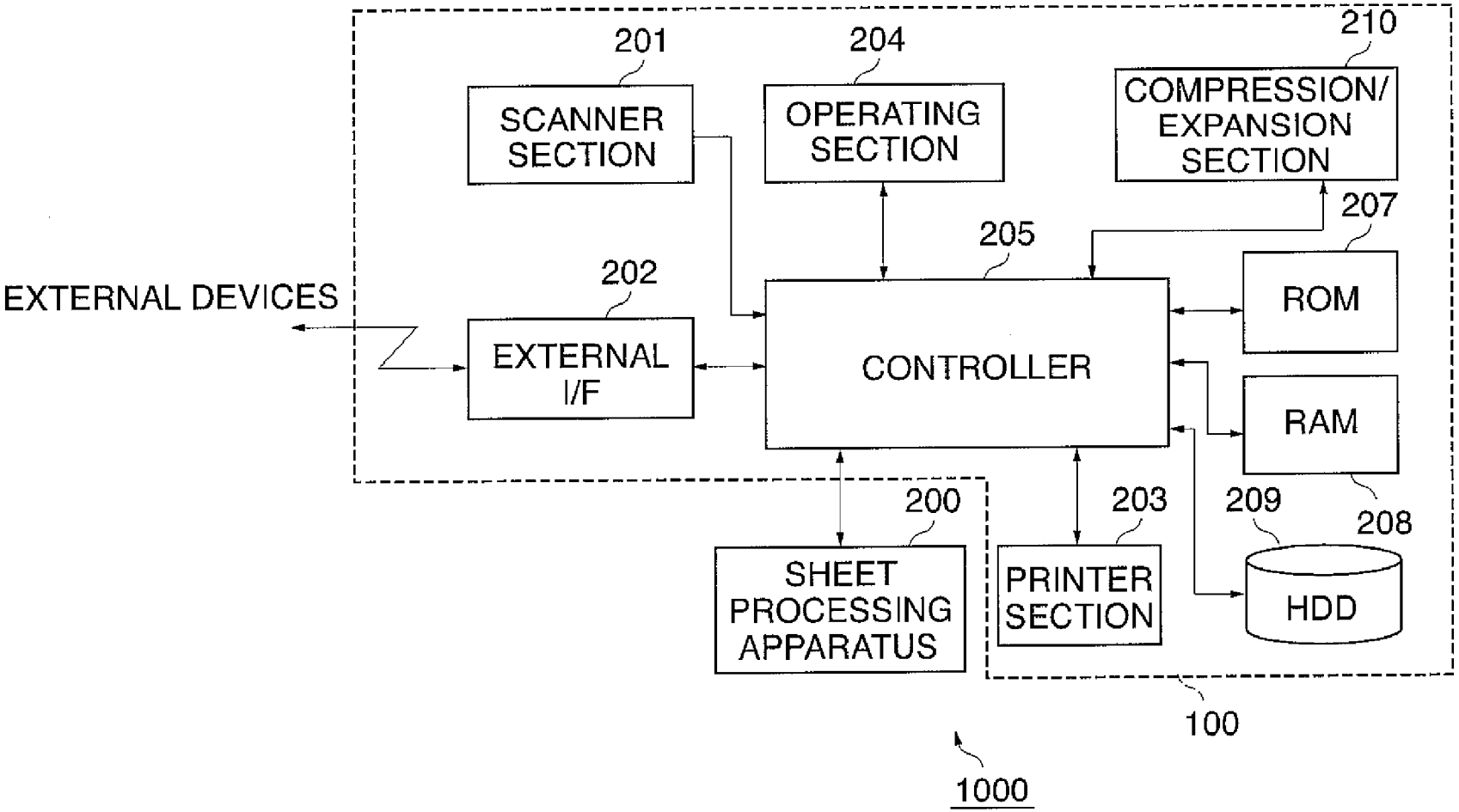
FIG. 2 is a block diagram of the printing system.

FIG. 2 is a block diagram of the printing system 1000.

As shown in FIG. 2, the printing system 1000 is comprised of a printing apparatus 100 and sheet processing apparatuses (post-processing apparatuses) 200 connected to the printing apparatus 100. In the present embodiment, the printing apparatus 100 is implemented by an MFP (Multi-Function Peripheral) equipped with a plurality of functions including a copying function and a printing function. It should be noted that the printing apparatus 100 may be a single-function printing apparatus having only the copying function or the printing function.

Units included in the printing system 1000 belong to the printing apparatus 100 except the sheet processing apparatuses 200. The printing apparatus 100 can have an optional number of sheet processing apparatuses 200 connected thereto. The printing system 1000 is configured to be capable of causing the sheet processing apparatuses 200 connected to the printing apparatus 100 to execute sheet processing (post processing) on sheets printed by the printing apparatus 100. It should be noted that it is possible to form the printing system 1000 by the printing apparatus 100 alone without connecting the sheet processing apparatuses 200 to the printing apparatus 100.

Each of the sheet processing apparatuses 200 is communicable with the printing apparatus 100, and is capable of performing post processing, described hereinafter, in response to an instruction from the printing apparatus 100. A scanner section 201 reads an image from an original and converts the image into image data, followed by transferring the image data to another unit. An external I/F 202 exchanges data with other apparatuses (external devices) connected to the network 101. A printer section 203 prints an image on a sheet based on input image data. An operating section 204 has a hard key input section (key input section) 402 and a touch panel section 401, described hereinafter, and accepts instructions from the operator via the hard key input section 402 or the touch panel section 401. Further, the operating section 204 performs various kinds of display on the touch panel section 401.

A controller 205 performs centralized overall control of the processing and operations of the respective units included in the printing system 1000. More specifically, the controller 205 controls not only the operation of the printing apparatus 100, but also that of each of the sheet processing apparatuses 200 connected to the printing apparatus 100. A ROM 207 stores various computer programs to be executed by the controller 205. For example, the ROM 207 stores programs for causing the controller 205 to execute processes of respective flowcharts, described hereinafter, and a display control program required for displaying various kinds of configuration screens, described hereinafter. Further, the ROM 207 stores a program for causing the controller 205 to perform an operation for interpreting PDL (Page Description Language) code data received from the PC 103, the PC 104, or the like, and converting the data into raster image data. Furthermore, the ROM 207 stores a boot sequence, font information, etc.

A RAM 208 stores image data sent from the scanner section 201 or the external I/F 202, various kinds of programs loaded from the ROM 207, and configuration information. Further, the RAM 208 stores information concerning the sheet processing apparatuses 200. The information concerning the sheet processing apparatuses 200 includes the number (0 to n) of the apparatuses connected to the printing apparatus 100, information concerning the functions of each of the sheet processing apparatuses 200, the connection order of the sheet processing apparatuses 200, and so forth.

A HDD (hard disk drive) 209 includes a hard disk and a drive section that reads/writes data from/into the hard disk. The HDD 209 is a large-capacity storage device for storing image data input from the scanner section 201 or the external I/F 202 and compressed by a compression/expansion section 210. The controller 205 is capable of causing the printer section 203 to print image data stored in the HDD 209, based on an instruction from the operator. Further, the controller 205 is capable of sending image data stored in the HDD 209 to an external device, such as the PC 103, via the external I/F 202 based on an instruction from the operator. The compression/expansion section 210 compresses/expands image data and the like stored in the RAM 208 or the HDD 209 using one of various kinds of compression methods including JBIG and JPEG.

Figure 3:
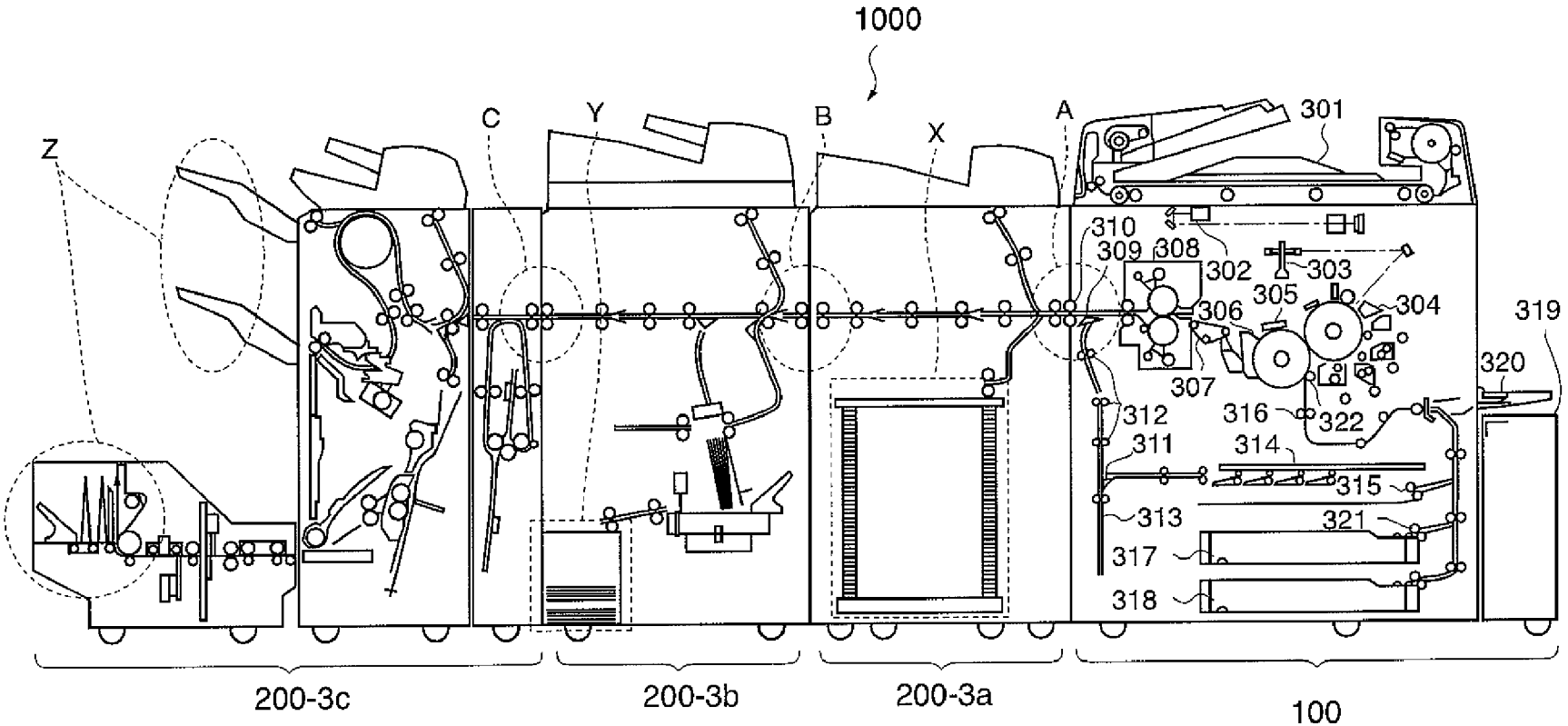
FIG. 3 is a schematic longitudinal cross-sectional view of a printing apparatus and a plurality of sheet processing apparatuses constituting the printing system.

FIG. 3 is a schematic longitudinal cross-sectional view of the printing apparatus 100 and the sheet processing apparatuses 200 constituting the printing system 1000.

Referring to FIG. 3, the sheet processing apparatuses 200 in the printing system 1000 can be optionally selected from various kinds of sheet processing apparatuses to connect a desired number of them to one another insofar as sheets can be sequentially conveyed from an upstream apparatus to a downstream one through a sheet conveying path. For example, as shown in FIG. 3, a large-capacity stacker 200-3*a*, a glue binding machine 200-3*b*, and a saddle stitching machine 200-3*c* can be sequentially connected to one another in the mentioned order as viewed from the printing apparatus 100, and can be selectively used in the printing system 1000. Further, each of the sheet processing apparatuses 200 has a sheet discharging section, so that the operator can take out sheets having undergone sheet processing from the sheet discharging section.

An automatic document feeder (ADF) 301 sequentially separates sheets of an original bundle set on the sheet stacking surface of a document tray, one by one in order from a first page, and conveys the separated sheets one by one onto an original platen glass for scanning by the scanner section 302.

The scanner section 302 reads an image from an original conveyed onto the original platen glass and converts the image into image data by a CCD (Charge Coupled Device). A rotary polygon mirror 303 receives light, such as a laser beam, modulated according to the image data, and emits the light onto a photosensitive drum 304 via a reflective mirror as reflected scanning light. A latent image formed on the photosensitive drum 304 by the laser beam is developed by toner, and the developed toner image is transferred onto a sheet wound around a transfer drum 305. This sequential image forming process is carried out sequentially using yellow (Y) toner, magenta (M) toner, cyan (C) toner, and black (K) toner in the mentioned order, whereby a full-color image is formed.

After execution of the four image forming processes, the sheet having the full-color image formed thereon is separated from the transfer drum 305 by a separation claw 306, and is conveyed to a fixing device 308 by a pre-fixing conveyor 307. The fixing device 308 incorporates rollers, a belt, and a heater, such as a halogen heater, and dissolves toner of the toner image transferred on the sheet having, by heat and pressure, to thereby fix the toner image on the sheet. A discharge flapper 309 is configured to be swingable about a swing shaft to regulate a sheet conveying direction. When the discharge flapper 309 has swung in a clockwise direction as viewed in FIG. 3, a sheet is conveyed straight to be discharged out of the apparatus by a discharge roller 310. The controller 205 causes the printing apparatus 100 to execute the above-mentioned series of sequences to thereby perform single-sided printing.

On the other hand, in the case of forming images on the respective opposite sides of a sheet, the discharge flapper 309 swings in a counterclockwise direction as viewed in FIG. 3, to change a sheet conveying direction downward, whereby a sheet is conveyed into a double-sided conveyor. The double-sided conveyor is comprised of an inverting flapper 311, inverting rollers 312, an inverting guide 313, and a double-sided tray 314. The inverting flapper 311 swings about a swing shaft to regulate a sheet conveying direction.

In the case of processing a double-sided printing job, the controller 205 swings the inverting flapper 311 in the counterclockwise direction as viewed in FIG. 3 to thereby convey a sheet having an image formed on a first side thereof in the printer section 203 to the inverting guide 313 via the inverting rollers 312. Then, the controller 205 temporarily stops the inverting rollers 312 in a state nipping the trailing end of the sheet, followed by swinging the inverting flapper 311 in the clockwise direction as viewed in FIG. 3. Then, the controller 205 causes the inverting roller 312 to perform reverse rotation. Thus, the controller 205 causes the sheet to be conveyed in a switched-back manner, whereby the sheet is guided onto the double-sided tray 314 with its leading and trailing ends reversed.

The sheet guided to the double-sided tray 314 is temporarily placed thereon, and then conveyed to a registration roller 316 again by reefed rollers 315. At this time, the sheet is conveyed with a reverse side thereof opposite to the first side in a facing relation to the photosensitive drum. Then, a second-side image is formed on the second side (reverse side) of the sheet by processes similar to those associated with the first side. Thus, the sheet having the images formed on the both sides thereof passes through the fixing device 308, followed by being discharged out from the printing apparatus 100 via the discharge roller 310. The controller 205 causes the printing apparatus 100 to execute the above-mentioned series of sequences to thereby to perform double-sided printing.

The printing apparatus 100 has feeder sections each containing sheets necessary for printing. The feeder sections include sheet feed cassettes 317 and 318 (each of which is capable of containing 500 sheets, for example), a sheet feed deck 319 (which is capable of containing 5000 sheets, for example), and a manual feed tray 320. The sheet feed cassettes 317 and 318 and the sheet feed deck 319 are configured such that sheets of kinds different in size and material can be separately set in the respective feeder sections. It is possible to set various kinds of sheets including special sheets, such as OHP sheets, on the manual feed tray 320. Each of the sheet feed cassettes 317 and 318, the sheet feed deck 319, and the manual feed tray 320 is provided with a feed roller, and sheets therein are continuously fed one by one by the feed roller.

Next, a description will be given of the sheet processing apparatuses 200 appearing in FIG. 3.

The controller 205 accepts, as a job, a request for execution of sheet processing of a kind selected by the operator from candidates of various kinds of sheet processing executable by the sheet processing apparatuses 200 connected to the printing apparatus 100, via the operating section 204 together with a printing execution request. Then, in response to the printing execution request of the job accepted from the operator via the operating section 204, the controller 205 causes the printer section 203 to execute print processing required for the job. Further, the controller 205 causes sheets having undergone the print processing to be conveyed through the sheet conveying path to a sheet processing apparatus which is capable of executing the sheet processing desired by the operator, and causes the sheet processing apparatus to execute the sheet processing.

Let it be assumed that the printing system 1000 having a system configuration shown in FIG. 3 accepts from the operator a job which is associated with a printing execution request and instructs execution of large-quantity stacking processing by the large-capacity stacker 200-3*a*. This job will be referred to as "the stacker job". In the case of processing the stacker job in the printing system 1000 shown in FIG. 3, the controller 205 causes the printing system 1000 to convey sheets printed by the printing apparatus 100 into the large-capacity stacker 200-3*a* while passing the sheets over a point A appearing in FIG. 3. Thereafter, the controller 205 causes the large-capacity stacker 200-3*a* to execute stacking processing of the stacker job. Then, the controller 205 holds a printout (one set of printed sheets) subjected to the stacking processing by the large-capacity stacker 200-3*a* in a discharge destination X within the large-capacity stacker 200-3*a*, without conveying the printout to another apparatus (e.g. an apparatus disposed downstream of the printing apparatus).

The printout held in the discharge destination X for the stacker job can be taken out directly from the discharge destination X by the operator. This eliminates the necessity of a series of apparatus operations and an operator operation for conveying sheets to a discharge destination Z most downstream in the sheet conveying direction in FIG. 3 and then taking out the printout for the stacker job.

Let it be assumed that in the print system 1000, a job associated with a printing execution request accepted from the operator instructs execution of sheet processing (e.g. glue binding selected between case binding and top gluing) by the glue binding machine 200-3*b*. This job will be referred to as "the glue binding job". In the case of processing the glue binding job in the printing system 1000, the controller 205 causes the printing system 1000 to convey sheets printed by the printing apparatus 100 into the glue binding machine 200-3*b* while passing the sheets over the point A and a point B appearing in FIG. 3. Thereafter, the controller 205 causes the glue binding machine 200-3*b* to execute glue binding of the glue binding job. Then, the controller 205 holds the printout subjected to the glue binding by the glue binding machine 200-3*b* in a discharge destination Y within the glue binding machine 200-3*b*, without conveying the printout to another apparatus (e.g. an apparatus disposed downstream of the printing apparatus).

Let it be assumed that in the printing system 1000, a job associated with a printing execution request accepted from the operator instructs execution of sheet processing by the saddle stitching machine 200-3*c*. Examples of sheet processing executed by the saddle stitching machine 200-3*c* include saddle-stitch processing, stapling, punching, trimming, shift discharging, and folding. In the present embodiment, the job instructing execution of sheet processing by the saddle stitching machine 200-3*c* will be referred to as "the saddle-stitch job".

In the case of processing the saddle-stitch job in the printing system 1000, the controller 205 causes the printing system 1000 to convey sheets printed by the printing apparatus 100 into the saddle stitching machine 200-3*c* while passing the sheets over the points A and B and a point C. Thereafter, the controller 205 causes the saddle stitching machine 200-3*c* to execute the sheet processing of the saddle-stitch job. Then, the controller 205 holds the printout subjected to the sheet processing by the saddle stitching machine 200-3*c* in the discharge destination Z within the saddle stitching machine 200-3*c*.

It should be noted that the discharge destination z is selected from a plurality of candidate discharge destinations. This is because the saddle stitching machine 200-3*c* is capable of executing a plurality of kinds of sheet processing, and different discharge destinations are used for the respective kinds of processing.

Next, the internal construction of the saddle stitching machine 200-3*c* will be described as an example of the sheet processing apparatus 200 connectable to the printing apparatus 100 with reference to FIG. 4.

Figure 4:
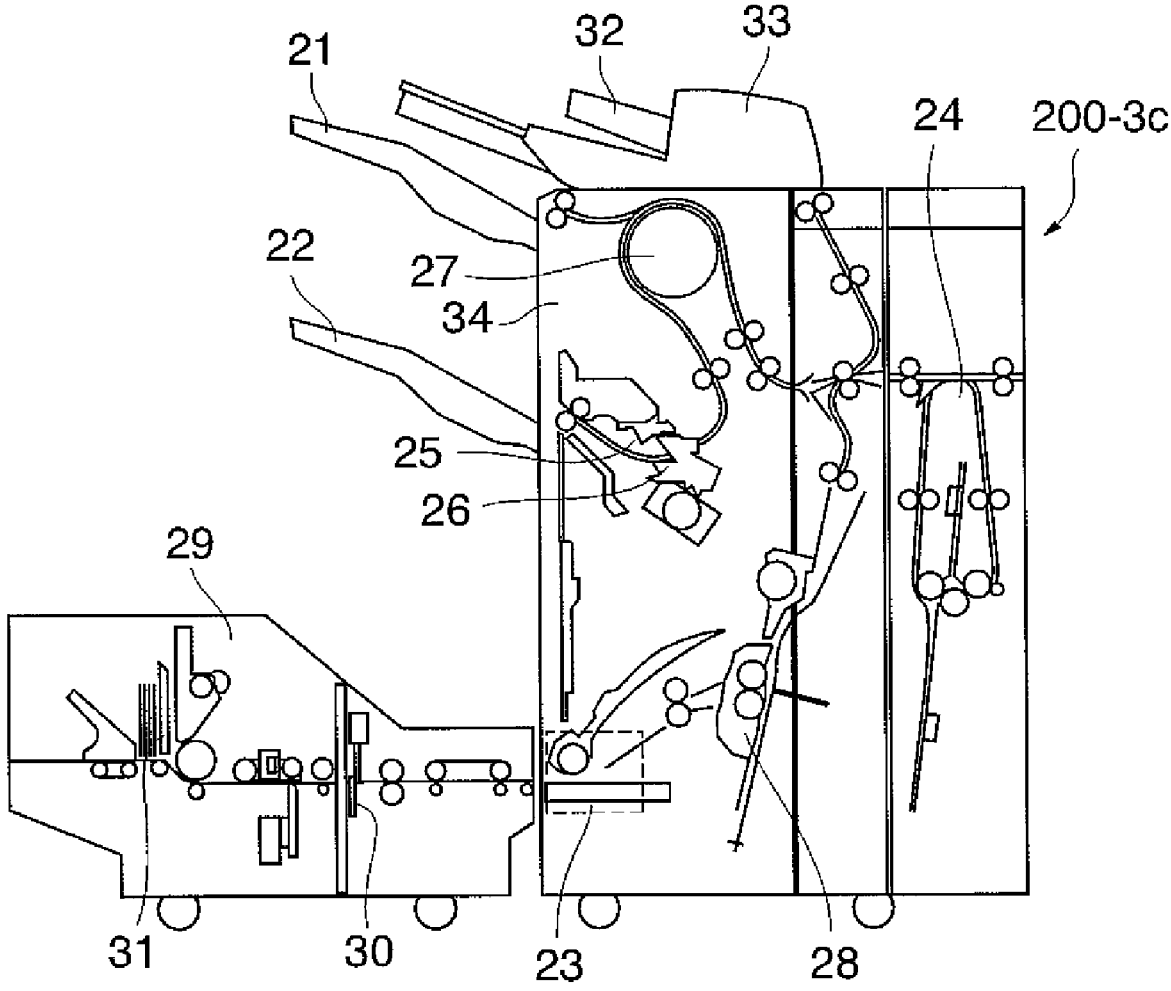
FIG. 4 is a schematic longitudinal cross-sectional view of a saddle stitching machine.

FIG. 4 is a schematic longitudinal cross-sectional view of the saddle stitching machine 200-3*c*.

The saddle stitching machine 200-3*c* is comprised of units enabling selective execution of stapling, trimming, punching, folding, shift discharging, and saddle-stitch processing, on sheets from the printing apparatus 100. Further, the saddle stitching machine 200-3*c* is capable of performing square back processing, described hereinafter. It should be noted that the saddle stitching machine 200-3*c* does not have a straight path for conveying sheets to a downstream apparatus. For this reason, in a case where a plurality of sheet processing apparatuses are connected to the printing apparatus 100, the saddle stitching machine 200-3*c* is disposed at the most downstream position.

A finisher 34 has a sample tray 21 and a stack tray 22 attached to the outside thereof, and has a square back-forming section 23 provided therein. A Z-folding machine 24 is connected to the upstream side of the finisher 34. In the case of executing a job instructing execution of Z folding, the controller 205 causes the Z-folding machine 24 to fold sheets printed by the printing apparatus 100 into a Z shape. Then, the controller 205 performs control such that the folded sheets pass through the saddle stitching machine to be discharged onto a discharge tray, i.e. the stack tray 22 or the sample tray 21.

When instructed to perform stapling by the saddle stitching machine 200-3*c*, the controller 205 performs control such that sheets printed by the printing apparatus 100 are sequentially stacked on a processing tray 25 disposed in the saddle stitching machine 200-3*c*. Then, when a number of sheets corresponding to one bundle are stacked on the processing tray 25, the controller 205 causes a stapler 26 to perform stapling. Thereafter, the controller 205 performs control such that the stapled sheet bundle is discharged from the processing tray 25 onto the stack tray 22.

Further, when instructed to perform punching by the saddle stitching machine 200-3*c*, the controller 205 causes a puncher 27 to punch sheets printed by the printing apparatus 100. Then, the controller 205 performs control such that the punched sheets are conveyed through the saddle stitching machine 200-3*c* to be discharged onto a discharge tray, i.e. the stack tray 22 or the sample tray 21.

Furthermore, in the case of executing a job instructing execution of saddle-stitch processing by the saddle stitching machine 200-3*c*, the controller 205 causes a saddle stitcher 28 to stitch a central portion (folding position for half folding to be performed later) of a sheet bundle formed by a number of sheets corresponding to one set, at two locations on the central portion. Then, the controller 205 causes a roller to come into contact with the central portion of the sheet bundle to fold the sheet bundle in half about the central portion. Thus, the sheet bundle can be bound into a booklet form. In the present embodiment, the sequence of sheet processing executed by the saddle stitcher 28 and including the two steps of stitching a sheet bundle at two locations and folding the sheet bundle in half will be referred to as the saddle-stitch processing. The sheet bundle subjected to the saddle-stitch processing by the saddle stitcher 28 is conveyed to the square back-forming section 23.

A description will be given of a case where a job is processed which instructs execution of saddle-stitch processing on a sheet bundle and further square back processing on the back of the saddle-stitched sheet bundle. The controller 205 controls the printing system 1000 such that after the saddle stitcher 28 executes the saddle-stitch processing on the printout printed by the printing apparatus 100, processing for making square the back of the saddle-stitched sheet bundle is performed in the square back-forming section 23. After completion of the processing, the printout is conveyed to a discharge port.

When a job instructing execution of saddle-stitch processing includes an instruction for performing trimming, the controller 205 performs control such that a saddle-stitched sheet bundle is conveyed from the discharge port to a trimmer 29.

Thereafter, the controller 205 causes a cutter 30 to trim the sheet bundle conveyed to the trimmer 29, and then causes a booklet holding section 31 to hold the sheet bundle. The saddle stitching machine 200-3*c* shown in FIG. 4 is also configured to be capable of performing three-way trimming (processing for trimming three edges of a sheet bundle except for the back of the same) on a saddle-stitched sheet bundle. It should be noted that when the saddle stitching machine 200-3*c* does not have the trimmer 29, it is possible to take out a sheet bundle bound by the saddle stitcher 28 from the discharge port.

The saddle stitching machine 200-3*c* is also configured to be capable of attaching a sheet (e.g. a cover sheet printed in advance) set in an insert tray 32 on an inserter 33 to sheets conveyed from the printing apparatus 100.

Next, square back processing executed by the square back-forming section 23 will be described with reference to FIGS. 5A to 5C. The square back-forming section 23 functions as a processing unit for crushing the back of a printout which is saddle-stitched by the aforementioned saddle stitcher 28, to thereby flatten the back (i.e. to form a flat surface). In the present embodiment, by using this function, the printing system 1000 can create a saddle-stitched brochure having its back flattened.

Figure 5C:
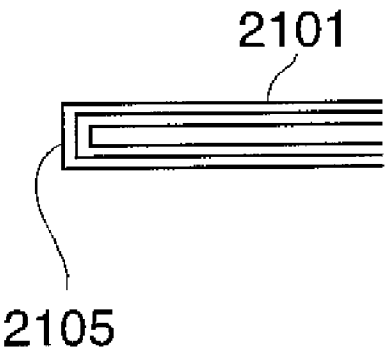
FIG. 5C is a schematic view of the sheet bundle having undergone the square back processing, which is useful in explaining the outline of the square back processing.
Figure 5B:
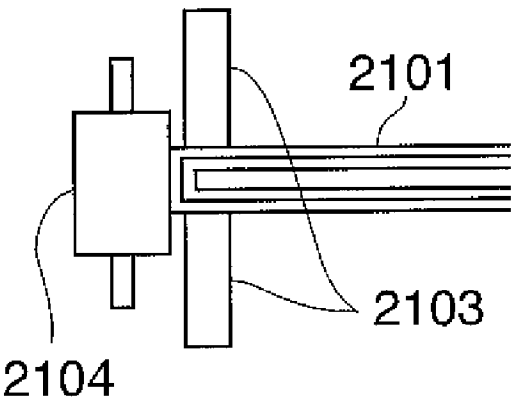
FIG. 5B is a schematic View of the sheet bundle being subjected to the square back processing by a square back-forming section, which is useful in explaining the outline of the square back processing.
Figure 5A:
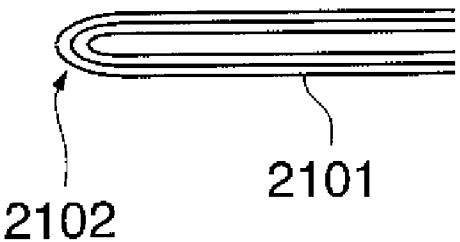
FIG. 5A is a schematic view of a sheet bundle having just undergone saddle stitching, which is useful in explaining the outline of square back processing.

FIGS. 5A to 5C are schematic views useful in explaining the outline of the square back processing, in which FIG. 5A shows a sheet bundle which has just been saddle-stitched, FIG. 5B the sheet bundle which is being subjected to the square back processing by the square back-forming section, and FIG. 5C the sheet bundle which has already undergone the square back processing.

A booklet 2101 shown in FIG. 5A corresponds to a sheet bundle as one set of sheets printed by the printing apparatus 100. The sheets forming the booklet 2101 are sequentially printed one by one by the printing apparatus 100, and are supplied to the saddle stitcher 28 of the saddle stitching machine 200-3*c*. Then, when all the sheets as one set required to form the sheet bundle are received by the saddle stitcher 28, the saddle-stitch processing described above is performed on the sheet bundle. Thereafter, the saddle-stitched sheet bundle (i.e. the booklet 2101) is conveyed directly from the saddle stitcher 28 to the square back-forming section 23.

A folded part 2102 appearing in FIG. 5A corresponds to the back (i.e. the part stitched by the saddle stitcher at two locations and folded in half) of the booklet 2101.

As shown in FIG. 5B, the square back-forming section 23 has booklet-flattening members 2103 and 2104. These members are movable, and are configured to move from a predetermined standby position to abut on the booklet 2101 so as to perform the square back processing on the booklet 2101. Further, the members are configured to move back to the standby position upon completion of the square back processing so as to avoid interfering with conveyance of the booklet 2101.

The sheet bundle (booklet 2101) subjected to the saddle-stitch processing by the saddle stitcher 28 as described above is conveyed to the square back-forming section 23 with the folded part 2102 in the leading position as shown in FIG. 5A. Then, the booklet 2101 is nipped from the opposite sides by the booklet-flattening member 2103 as shown in FIG. 5B. Further, the folded part 2102 of the booklet 2101 is crushed by the booklet-flattening member 2104 to be flattened. The booklet 2101 thus undergoes the processing by the booklet-flattening members 2103 and 2104, whereby a flat surface 2105 is formed on the end of the folded part 2102 as shown in FIG. 5C.

In the present embodiment, the sequential sheet processing for flattening the back of a sheet bundle (i.e. forming a flat surface on the back) using the booklet-flattening members 2103 and 2104 so as to suppress bulging of the sheet bundle saddle-stitched by the saddle stitcher 28 is referred to as square back processing. The square back processing is also called a squaring process or square hold processing.

The booklet 2101 having undergone the square back processing is output to the booklet holding section 31 via the cutter 30 at a downstream location in the sheet conveying direction within the saddle stitching machine 200-3*c*.

The saddle-stitch job requiring saddle-stitch processing is roughly classified into one which requires square back processing, as described above, and another which does not. Whichever saddle-stitch job is selected, it is possible to output an associated printout to the booklet holding section 31 via the same conveying path.

For example, even a printout for the saddle-stitch job which does not require square back processing is also output to the booklet holding section 31 via the square back-forming section 23. In this case, the controller 205 locks the operations of the respective booklet-flattening members 2103 and 2104 so as to inhibit execution of square back processing by the square back-forming section 23. Then, in a state where the members are kept on standby, the printout for the saddle-stitch job is passed without being subjected to square back processing.

Next, the arrangement of the operating section 204 will be described with reference to FIG. 6.

The operating section 204 is comprised of a touch panel section 401 and a key input section 402. The touch panel section 401 is comprised of an LCD (Liquid Crystal Display) and transparent electrodes laminated on the same, and displays various kinds of configuration screens for accepting instructions from the operator. The touch panel section 401 has not only a function of displaying the various screens, but also an instruction input function of accepting the instructions from the operator. The key input section 402 includes a power key 501, a start key 503, a stop key 502, a user mode key 505, and ten keys 506. The start key 503 is used to cause the printing apparatus 100 to start a copy job or a transmission job. The ten keys 506 are used to enter numerical values indicative of a copy count and the like.

The controller 205 controls the printing system 1000 such that the printing system 1000 performs various kinds of processing responsive to instructions accepted via the respective screens displayed on the touch panel section 401 or via the key input section 402.

Figure 7:
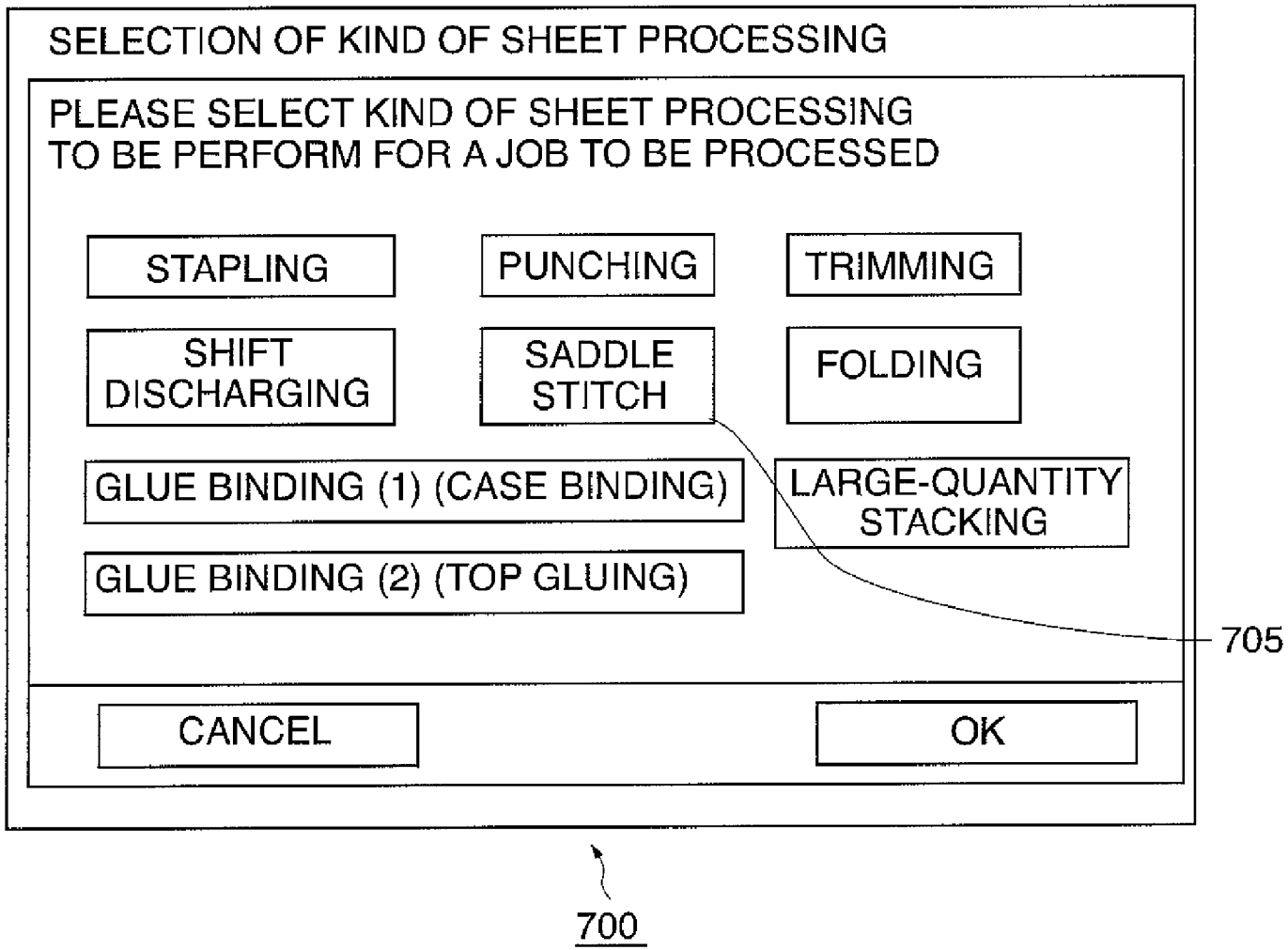
FIG. 7 is a view showing an example of a configuration screen prompting an operator to select a kind of sheet processing to be performed on sheets printed by the printing apparatus.

FIG. 7 is a view showing an example of a configuration screen prompting the operator to select the kind of sheet processing to be performed on sheets printed by the printing apparatus 100.

Figure 6:
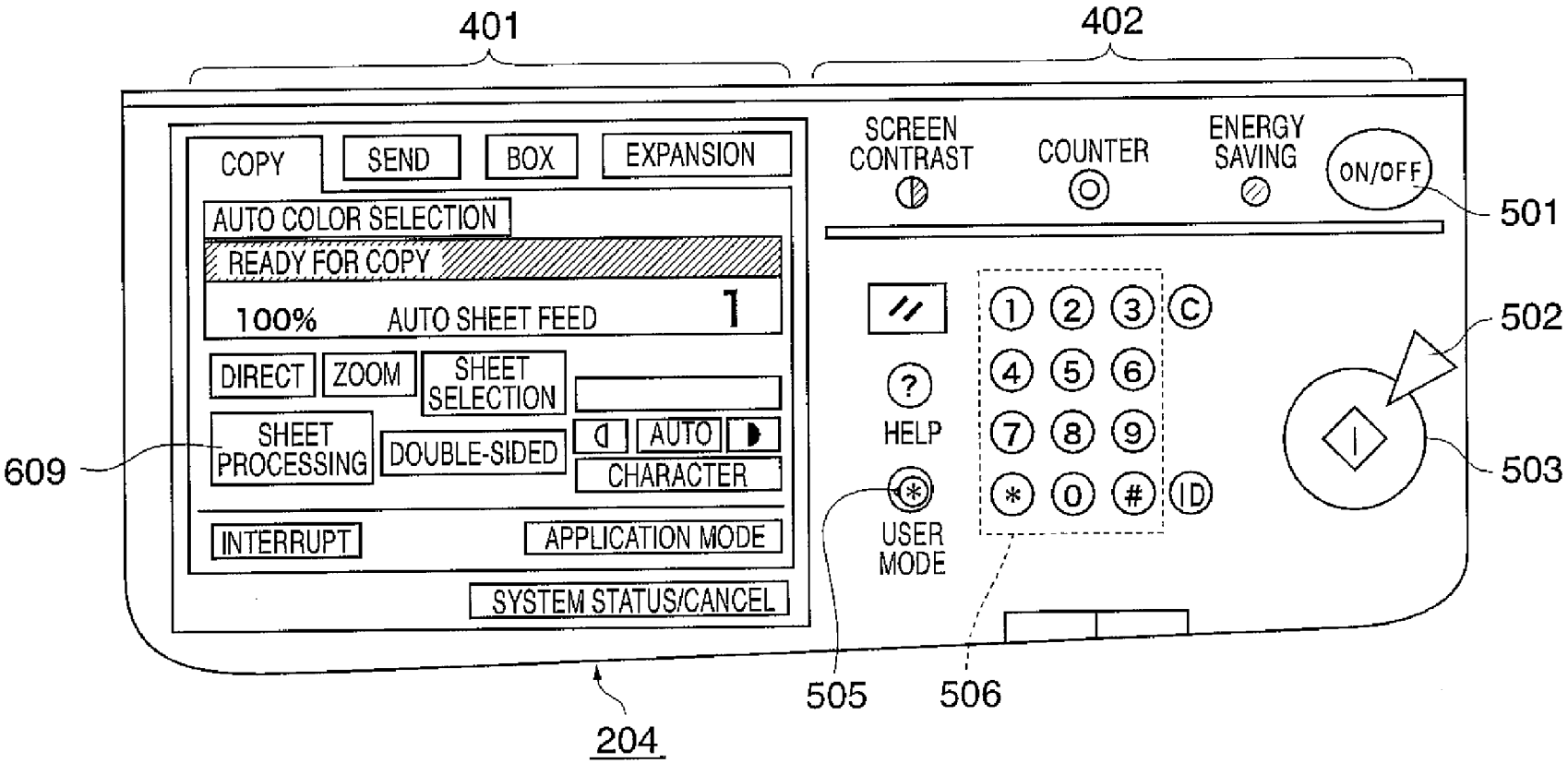
FIG. 6 is a view of the appearance of an operating section.

When the operator presses a sheet processing configuration key 609, appearing in FIG. 6, on the screen displayed on the touch panel section 401, the controller 205 displays the configuration screen 700 shown in FIG. 7 on the touch panel section 401. The configuration screen 700 enables the operator to select a desired one from various kinds of sheet processing executable by the sheet processing apparatuses 200 included in the printing system 1000. The controller 205 accepts settings of sheet processing to be executed in a job to be processed, from the operator, and causes the sheet processing apparatuses 200 to execute the sheet processing based on the settings.

Next, a case of processing an 8-page saddle-stitch job will be described as an example of saddle-stitch processing and print processing prior to the saddle-stitch processing.

Figure 8A:
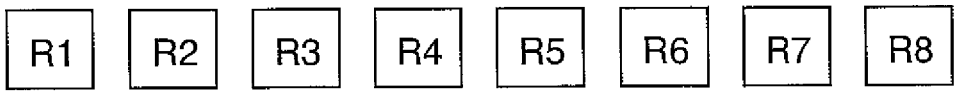
FIG. 8A is a view of image data for 8 pages, which is useful in explaining a flow of saddle-stitch processing and print processing prior to the saddle-stitch processing.
Figure 8B:
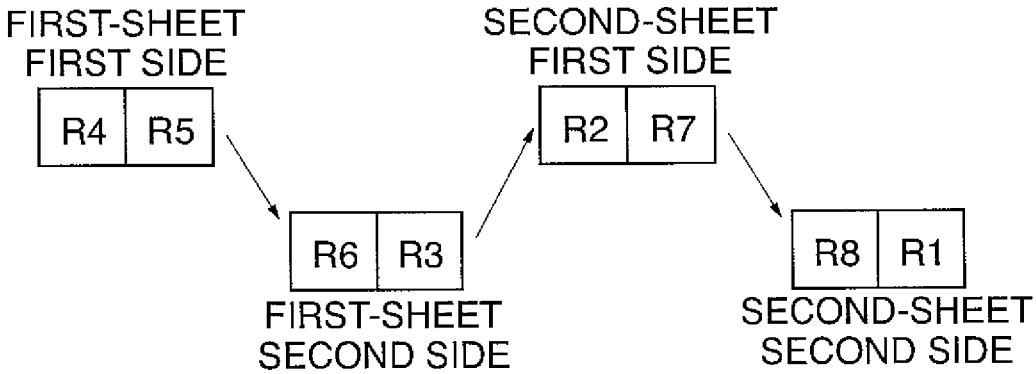
FIG. 8B is a view illustrating correspondence between the image data for 8 pages and image forming positions on sheets, which is useful in explaining the flow of the saddle-stitch processing and the print processing prior to the saddle-stitch processing.
Figure 8C:
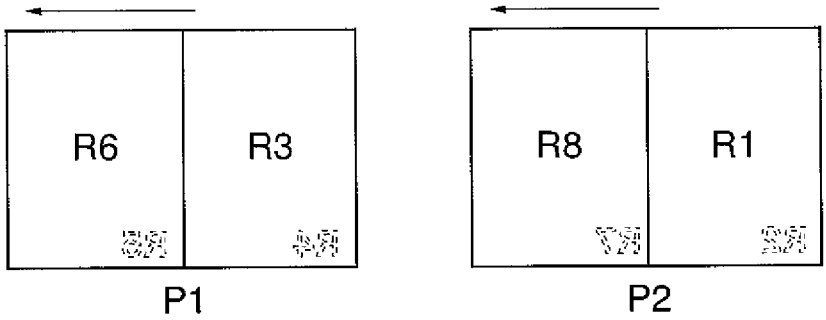
FIG. 8C is a view illustrating a sheet conveying direction of the sheets having associated images formed thereon, which is useful in explaining the flow of the saddle-stitch processing and the print processing prior to the saddle-stitch processing.
Figure 8D:
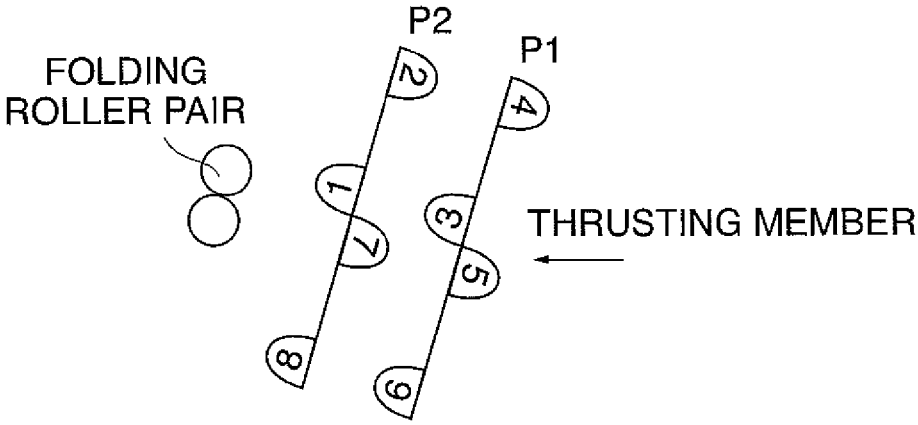
FIG. 8D is a view illustrating a saddle-stitch processing operation for saddle-stitch processing of a bundle of the sheets, which is useful in explaining the flow of the saddle-stitch processing and the print processing prior to the saddle-stitch processing.

FIGS. 8A to 8D are views useful in explaining a flow of the saddle-stitch processing and the print processing prior to the saddle-stitch processing, in which FIG. 8A illustrates image data for 8 pages, FIG. 8B illustrates correspondence between the image data for 8 pages and image forming positions on sheets, FIG. 8C illustrates a sheet conveying direction of the sheets having associated images formed thereon, and FIG. 8D illustrates a saddle-stitch processing operation for saddle-stitching a bundle of the sheets.

When a saddle stitching mode is set on the configuration screen 700, an image forming order and image forming positions of the image data items R1 to R8 for 8 pages are determined as shown in FIG. 8A. As a consequence, as shown in FIG. 8B, an image associated with the image data item R4 is formed on the left half of a first side (front side) of a first sheet (sheet P1), and an image associated with the image data item R5 is formed on the right half of the same. Further, an image associated with the image data item R6 is formed on the left half of a second side (reverse side) of the sheet P1, and an image associated with the image data item R3 is formed on the right half of the same.

The sheet P1 having the images formed on the opposite sides thereof is conveyed in a direction indicated by an arrow in FIG. 8C, with a second side on which the images associated with the respective image data items R6 and R3 are formed facing upward, and with the image associated with the image data item R6 in the leading position, as shown in FIG. 8C. Thereafter, processing for a second sheet is started. As shown in FIG. 8B, an image associated with the image data item R2 is formed on the left half of a first side (front side) of the second sheet (sheet P2), and an image associated with the image data item R7 is formed on the right half of the same. Further, an image associated with the image data item R8 is formed on the left half of a second side (reverse side) of the sheet P2, and an image associated with the image data item R1 is formed on the right half of the same.

As shown in FIG. 8D, a thrusting member of the saddle stitcher 28 is thrust against a sheet bundle formed by the sheets P1 and P2 having the images formed thereon. As a consequence, the sheet bundle is pushed toward a folding roller pair. The sheet bundle pushed toward the folding roller pair is folded about a central portion (which corresponds to a boundary between the images on each of the image-formed surfaces) by the folding roller pair, and then delivered to the square back-forming section 23.

Figure 9A:
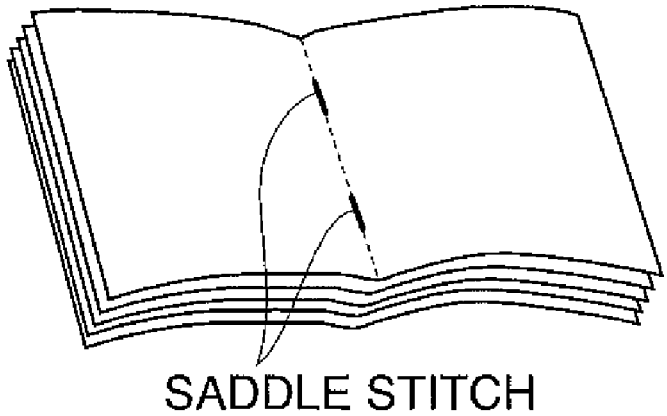
FIG. 9A is a perspective view showing an example of a saddle-stitched brochure without a square back, illustrating a printout in an opened state.
Figure 9B:
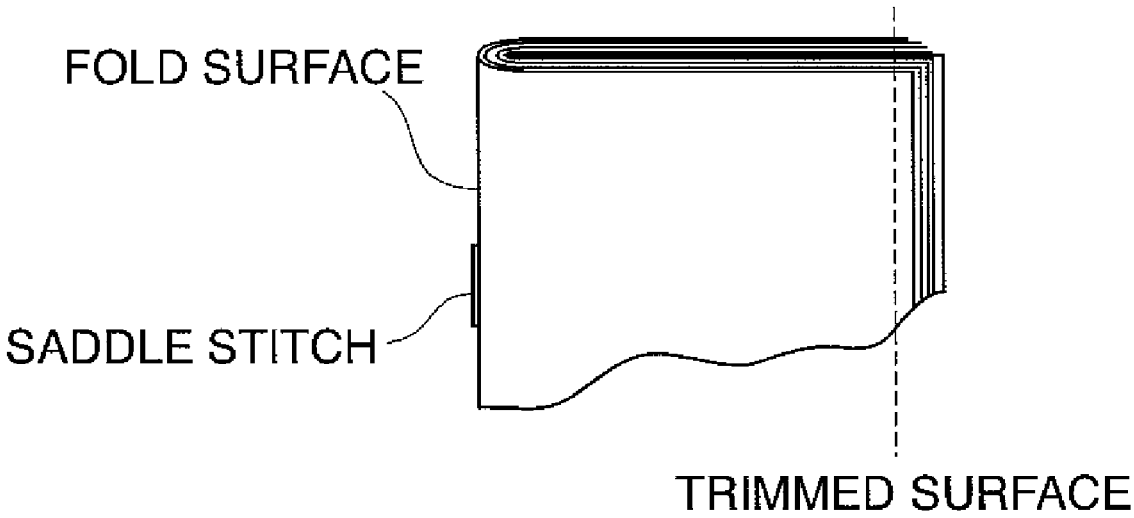
FIG. 9B is a perspective view showing the saddle-stitched brochure without a square back, illustrating a fold surface and a saddle stitch of the printout in a closed state.

The thus folded sheet bundle is formed into a printout shown in FIGS. 9A and 9B by way of example. FIG. 9A shows a saddle-stitched brochure without a square back in an opened state, and FIG. 9B shows a folding surface and a saddle stitch of the saddle-stitched brochure in a closed state. A trimmed surface denoted in FIG. 9B corresponds to a trimming position set in the case of trimming the sheet bundle by the trimmer 29.

The printing system 1000 according to the present embodiment includes the printer section 203 and the saddle stitcher 28, appearing in FIG. 4, which is capable of saddle-stitch processing of a sheet bundle having undergone print processing by the printer section 203. Further, the printing system 1000 includes the square back-forming section 23, appearing in FIG. 4, which is capable of performing square back processing for forming a flat surface on the back of a sheet bundle saddle-stitched by the saddle stitcher 28. These units function as a printing unit, a saddle stitching unit, and a working unit, respectively.

Thus, the printing system 1000 according to the present embodiment is configured to be capable of forming a saddle-stitched brochure subjected to the square back processing using the above-mentioned units. The saddle-stitched brochure has its back formed with a flat surface. In the present embodiment, this type of saddle-stitched brochure is categorized as a saddle-stitched brochure of a first type, and a job for creating a printout in this form is categorized as a first-type job. The controller 205 performs control such that the printing system 1000 can execute processing required for the first-type job.

The printing system 1000 according to the present embodiment can also create a saddle-stitched brochure not subjected to square back processing, using the aforementioned printer section 203 and the saddle stitcher 28. The saddle-stitched brochure not subjected to the square back processing has a back not formed with a flat surface. In the present embodiment, this type of saddle-stitched brochure is categorized as a saddle-stitched brochure of a second type, and a job for creating a printout in this form is categorized as a second-type job. The controller 205 performs control such that the printing system 1000 can also execute processing required for the second-type job.

In the present embodiment, the controller 205 functions as a job control unit for causing the printing system 1000 to create a saddle-stitched brochure of the first type based on requests from the operator for a job to be processed by the printing system 1000. Further, the controller 205 performs control such that the printing system 1000 can create a saddle-stitched brochure of the second type based on requests from the operator for a job to be processed by the printing system 1000. Furthermore, in the present embodiment, the controller 205 functions not only as the job control unit, but also as a control unit.

For example, the controller 205 controls whether to permit or inhibit creating a saddle-stitched brochure of the first type and/or a saddle-stitched brochure of the second type according to the number and/or type of sheets required for one printout (one set of printed sheets) in a job to be processed by the printing system 1000. The printing system 1000 according to the present embodiment is provided with various capabilities, as described hereinafter, to support this control. Thus, the printing system 1000 is configured such that the controller 205 can perform [Control 1] to [Control 8] described below.

[Control 1] Assume a case where a job to be processed by the printing system 1000 requires a number of sheets not more in number than a predetermined number of sheets allowable in creating a saddle-stitched brochure of the aforementioned first type so as to create one printout. If it is determined that this case applies to a job, the controller 205 permits the printing system 1000 to create a saddle-stitched brochure of the aforementioned second type for the job (i.e. permits the second-type job). Assume, on the other hand, a case where a job to be processed by the printing system 1000 requires a number of sheets more in number than the above-mentioned predetermined number of sheets so as to create one printout. If it is determined that this case applies to a job, the controller 205 inhibits the printing system 1000 from creating a saddle-stitched brochure of the aforementioned second type for the job (i.e. inhibits the second-type job). As the predetermined number, there is applied such a number that if the number of sheets required for a job is more than the number, the second-type job (for creating a saddle-stitched brochure without a square back) is not permitted, but the first-type job (for creating a saddle-stitched brochure with a square back) is permitted. The printing system 1000 according to the present embodiment is configured such that a specific numerical value corresponding to the predetermined number of sheets is set to 15, by way of example. The controller 20S functions based on [Rule 2] and/or [Rule 3] described in a management table 2100, shown in FIG. 21, registered in advance in a memory (e.g. the HDD 209) of the printing apparatus 100, whereby [Control 1] is executed. For example, assume a case where a saddle-stitch job requires not more than 15 sheets to be printed as one set by the printer section 203. If it is determined that this case applies to a job, the controller 205 permits the printing system 1000 to create a saddle-stitched brochure of the second type for the job. Assume, on the other hand, a case where a saddle-stitch job requires not less than 16 sheets to be printed as one set by the printer section 203. If it is determined that this case applies to a job, the controller 205 inhibits the printing system 1000 from creating a saddle-stitched brochure of the second type for the job.

It should be noted that the printing system 1000 according to the present embodiment is configured such that the controller 205 can perform not only [Control 1], but also [Control 2] described below.

[Control 2] Assume a case where a job to be processed by the printing system 1000 requires a number of sheets not less in number than a predetermined number of sheets allowable in creating a saddle-stitched brochure of the aforementioned second type so as to create one printout. If it is determined that this case applies to a job, the controller 205 permits the printing system 1000 to create a saddle-stitched brochure of the aforementioned first type for the job. Assume, on the other hand, a case where a job to be processed by the printing system 1000 requires a number of sheets less in number than the above-mentioned predetermined number of sheets. If it is determined that this case applies to a job, the controller 205 inhibits the printing system 1000 from creating a saddle-stitched brochure of the first type for the job. As the predetermined number, there is applied such a number that if the number of sheets required for a job is less than the number, the first-type job (for creating a saddle-stitched brochure with a square back) is not permitted, but the second-type job (for creating a saddle-stitched brochure without a square back) is permitted. This number is used for control by the controller 205. The printing system 1000 according to the present embodiment is configured such that a specific numerical value corresponding to the predetermined upper limit number of sheets is set to 5, by way of example. The controller 205 functions based on [Rule 1] and/or [Rule 2] described in the management table 2100, whereby the [Control 2] is executed. For example, assume a case where a saddle-stitch job requires not less than 5 sheets to be printed as one set by the printer section 203. If it is determined that this case applies to a job, the controller 205 permits the printing system 1000 to create a saddle-stitched brochure of the first type for the job. Assume, on the other hand, a case where a saddle-stitch job requires less than 5 sheets (i.e. 1 to 4 sheets) to be printed as one set by the printer section 203. If it is determined that this case applies to a job, the controller 205 inhibits the printing system 1000 from creating a saddle-stitched brochure of the first type for the job.

It should be noted that the printing system 1000 according to the present embodiment is configured such that the controller 205 can perform not only [Control 2], but also [Control 3] described below.

[Control 3] Assume a case where a job to be processed by the printing system 1000 requires a number of sheets not more in number than a predetermined number of sheets allowable in creating a saddle-stitched brochure of the first type so as to create one printout. In the illustrated example, the number not more than the predetermined number is any of 1 to 15. If it is determined that this case applies to a job, the controller 205 controls the printing system 1000 such that the printing system 1000 is permitted to create a saddle-stitched brochure of the second type for the job. Assume, on the other hand, a case where a job to be processed by the printing system 1000 requires a number of sheets (i.e. 16 to 20 sheets in the present example) more in number than the predetermined number of sheets so as to create one printout. If it is determined that this case applies to a job, the controller 205 controls the printing system 1000 such that the printing system 1000 is permitted to create a saddle-stitched brochure of the first type for the job without creating a saddle-stitched brochure of the second type. In the present embodiment, the controller 205 functions based on [Rule 2] and/or [Rule 3] described in the management table 2100, whereby [Control 3] is executed. For example, assume a case where a saddle-stitch job requires not more than 15 sheets to be printed as one set by the printer section 203. If it is determined that this case applies to a job, the controller 205 controls the printing system 1000 such that the printing system 1000 is permitted to create a saddle-stitched brochure of the second type for the job. Assume, on the other hand, a case where a saddle-stitch job requires more than 15 sheets (i.e. 16 to 20 sheets in the present example) to be printed as one set by the printer section 203. If it is determined that this case applies to a job, the controller 205 controls the printing system 1000 such that the printing system 1000 is permitted to create a saddle-stitched brochure of the first type for the job without creating a saddle-stitched brochure of the second type.

It should be noted that the printing system 1000 according to the present embodiment is configured such that the controller 205 can perform not only [Control 3], but also [Control 4] described below.

[Control 4] Assume a case where a job to be processed by the printing system 1000 requires a number of sheets not less in number than a predetermined number of sheets allowable in creating a saddle-stitched brochure of the second type so as to create one printout. In the illustrated example, the number not less than the predetermined number is any of 5 to 20. If it is determined that this case applies to a job, the controller 205 controls the printing system 1000 such that the printing system 1000 is permitted to create a saddle-stitched brochure of the first type for the job. Assume, on the other hand, a case where a job to be processed by the printing system 1000 requires a number of sheets less in number than the predetermined number of sheets (i.e. 1 to 4 sheets in the present example) so as to create one printout. If it is determined that this case applies to a job, the controller 205 controls the printing system 1000 such that the printing system 1000 is permitted to create a saddle-stitched brochure of the second type for the job without creating a saddle-stitched brochure of the first type. In the present embodiment, the controller 205 functions based on [Rule 1] and/or [Rule 2] described in the management table 2100, whereby [Control 4] is executed. For example, assume a case where a saddle-stitch job requires not less than 5 sheets to be printed as one set by the printer section 203. If it is determined that this case applies to a job, the controller 205 controls the printing system 1000 such that the printing system 1000 is permitted to create a saddle-stitched brochure of the first type for the job. Assume, on the other hand, a case where a saddle-stitch job requires less than 5 sheets to be printed as one set by the printer section 203. If it is determined that this case applies to a job, the controller 205 controls the printing system 1000 such that the printing system 1000 is permitted to create a saddle-stitched brochure of the second type for the job without creating a saddle-stitched brochure of the first type.

It should be noted that the printing system 1000 according to the present embodiment is configured such that the controller 205 can perform not only [Control 4], but also [Control 5] described below.

[Control 5] Assume a case where a job to be processed by the printing system 1000 requires a number of sheets not less in number than a first number of sheets and not more in number than a second number of sheets (second number>first number) so as to create one printout. If it is determined that this case applies to a job, the controller 205 permits the printing system 1000 to create a saddle-stitched brochure of the second type for the job. Assume, on the other hand, a case where a job to be processed by the printing system 1000 requires a number of sheets more in number than the second number of sheets so as to create one printout. If it is determined that this case applies to a job, the controller 205 inhibits the printing system 1000 from creating a saddle-stitched brochure of the second type for the job. In the present embodiment, as the first number, there is applied a number which is allowable at least in the second-type job, and as the second number, there is applied a number which is allowable at least in the first-type job. The controller 205 functions based on at least one of [Rule 2] to [Rule 4] described in the management table 2100, whereby [Control 5] is executed. For example, assume a case where a saddle-stitch job requires not more than 15 sheets (e.g. 10 sheets) to be printed as one set by the printer section 203. If it is determined that this case applies to a job, the controller 205 permits the printing system 1000 to create a saddle-stitched brochure of the second type for the job. Assume, on the other hand, a case where a saddle-stitch job requires more than 15 sheets (e.g. 20 sheets) to be printed a one set by the printer section 203. If it is determined that this applies to a job, the controller 205 inhibits the printing system 1000 from creating a saddle-stitched brochure of the second type for the job.

It should be noted that the printing system 1000 according to the present embodiment is configured such that the controller 205 can perform not only [Control 5], but also [Control 6] described below.

[Control 6] Assume a case where a job to be processed by the printing system 1000 requires a number of sheets not less in number than a first number of sheets and not more in number than a second number of sheets. If it is determined that this case applies to a job, the controller 205 permits the printing system 1000 to create a saddle-stitched brochure of the first type for the job. Assume, on the other hand, a case where a job to be processed by the printing system 1000 requires a number of sheets less in number than the first number of sheets so as to create one printout. If it is determined that this applies to a job, the controller 205 inhibits the printing system 1000 from creating a saddle-stitched brochure of the first type for the job. In the present embodiment, the controller 205 functions based on at least one of [Rule 1] to [Rule 4] described in the management table 2100, whereby [Control 6] is executed as well. For example, assume a case where a saddle-stitch job requires not less than 5 sheets (e.g. 10 sheets) to be printed as one set by the printer section 203. If it is determined that this case applies to a job, the controller 205 permits the printing system 1000 to create a saddle-stitched brochure of the first type for the job. Assume, on the other hand, a case where a saddle-stitch job requires less than 5 sheets (e.g. 2 sheets) to be printed as one set by the printer section 203. If it is determined that this case applies to a job, the controller 205 inhibits the printing system 1000 from creating a saddle-stitched brochure of the first type for the job.

It should be noted that the printing system 1000 according to the present embodiment is configured such that the controller 205 can perform not only [Control 6], but also [Control 7] described below.

[Control 7] Assume a case where a job to be processed by the printing system 1000 requires a number of sheets not less in number than the first number of sheets and not more in number than the second number of sheets. In this case, if it is determined that the number of sheets required for the job falls within the range between the first number of sheets and the second number of sheets, the controller 205 controls the printing system 1000 such that the printing system 1000 is permitted to create a saddle-stitched brochure of the second type for the job. Assume, on the other hand, a case where a job to be processed by the printing system 1000 requires a number of sheets more in number than the second number of sheets so as to create one printout. If it is determined that this case applies to a job, the controller 205 controls the printing system 1000 such that the printing system 1000 is permitted to create a saddle-stitched brochure of the first type for the job without creating a saddle-stitched brochure of the second type. In the present embodiment, the controller 205 functions based on at least one of [Rule 1] to [Rule 4] described in the management table 2100, whereby [Control 7] as well is executed. For example, assume a case where a saddle-stitch job requires not less than 5 and not more than 15 sheets (e.g. 10 sheets) to be printed as one set by the printer section 203. If it is determined that this case applies to a job, the controller 205 permits the printing system 1000 to create a saddle-stitched brochure of the second type for the job. Assume, on the other hand, a case where a saddle-stitch job requires not less than 16 and not more than 24 sheets (e.g. 18 sheets) to be printed as one set by the printer section 203. If it is determined that this case applies to a job, the controller 205 controls the printing system 1000 such that the printing system 1000 is permitted to create a saddle-stitched brochure of the first type for the job without creating a saddle-stitched brochure of the second type.

It should be noted that the printing system 1000 according to the present embodiment is configured such that the controller 205 can perform not only [Control 7], but also [Control 8] described below.

[Control 8] Assume a case where a job to be processed by the printing system 1000 requires a number of sheets not less in number than the first number of sheets and not more in number than the second number of sheets. If it is determined that this applies to a job, the controller 205 controls the printing system 1000 such that the printing system 1000 is permitted to create a saddle-stitched brochure of the first type for the job. Assume, on the other hand, a case where a job to be processed by the printing system 1000 requires a number of sheets less in number than the first number of sheets so as to create one printout. If it is determined that this case applies to a job, the controller 205 controls the printing system 1000 such that the printing system 1000 is permitted to create a saddle-stitched brochure of the second type for the job without creating a saddle-stitched brochure of the first type for the job. In the present embodiment, the controller 205 functions based on at least one of [Rule 1] to [Rule 4] described in the management table 2100, whereby [Control 8] as well is executed. For example, assume a case where a saddle-stitch job requires not less than 5 and not more than 20 sheets (e.g. 18 sheets) to be printed as one set by the printer section 203. If it is determined that this case applies to a job, the controller 205 permits the printing system 1000 to create a saddle-stitched brochure of the first type for the job. Assume, on the other hand, a case where a job to be subjected to saddle-stitch processing requires less than 5 sheets (e.g. 4 sheets) to be printed as one set by the printer section 203. If it is determined that this applies to a job, the controller 205 controls the printing system 1000 such that the printing system 1000 is permitted to create a saddle-stitched brochure of the second type for the job without creating a saddle-stitched brochure of the first type.

The printing system 1000 is configured to be capable of controlling whether to permit or inhibit creation of a saddle-stitched brochure of the first type and/or a saddle-stitched brochure of the second type at least according to the number of sheets required for one printout (one set of printed sheets) for a job to be processed by the printing system 1000.

Above-described [Control 2], [Control 4], [Control 6], and [Control 8] are basically executed to restrict creation of a saddle-stitched brochure of the first type. In the present embodiment, this type of control will be referred to as "the first control". On the other hand, above-described [Control 1], [Control 3], [Control 5], and [Control 7] are basically executed to restrict creation of a saddle-stitched brochure of the second type. In the present embodiment, this type of control will be referred to as "the second control". The printing system 1000 according to the present embodiment is configured such that the two types of control operations are executed for a single job to be processed, on a job-by-job basis.

The management table 2100 is configured to enable the printing system 1000 to control whether to permit or inhibit creation of a saddle-stitched brochure of the aforementioned first type and/or a saddle-stitched brochure of the aforementioned second type at least according to the number of sheets required for one printout (one set of printed sheets) for a job to be processed by the printing system 1000. The management table 2100 describes the four rule information items as to whether to execute square back processing. A variable Z (positive integer) in the management table 2100 represents the total number of sheets (sheet count) required for creating one printout for a job to be processed, and is also used in flowcharts described hereinafter. The controller 205 reads out the rule information from the memory, as required, and performs control according to the rule information.

The controller 205 performs control based on [Rule 1] described in the management table 2100 in FIG. 21. More specifically, assume a case where the number of sheets required for creating one printout for a job to be processed is smaller than 5 ($Z<5$). If it is determined that this case (case 1)

applies to a job, the controller 205 performs control such that creation of a saddle-stitched brochure with a square back (i.e. a saddle-stitched brochure of the first type) can be inhibited in the job. In the case 1, however, the controller 205 permits creation of a saddle-stitched brochure without a square back (i.e. a saddle-stitched brochure of the second type) in the job.

The controller 205 also performs control based on [Rule 2] described in the management table 2100 in FIG. 21. More specifically, assume a case where the number of sheets required for creating one printout for a job to be processed is not less than 5 and not more than 15 ($5 \leqq Z \leqq 15$). If it is determined that this case (case 2) applies to a job, the controller 205 permits creation of a saddle-stitched brochure with a square back in the job. In the case 2, the controller 205 also permits creation of a saddle-stitched brochure without a square back.

Further, the controller 205 performs control based on [Rule 3] described in the management table 2100 in FIG. 21. More specifically, assume a case where the number of sheets required for creating one printout for a job to be processed is more than 15 and not more than 20 ($15 < Z \leqq 20$). If it is determined that this case (case 3) applies to a job, the controller 205 performs control such that creation of a saddle-stitched brochure without a square back can be inhibited in the job. In the case 3, however, the controller 205 permits creation of a saddle-stitched brochure with a square back.

Furthermore, the controller 205 performs control based on [Rule 4] described in the management table 2100 in FIG. 21. More specifically, assume a case where the number of sheets required for creating one printout for a job to be processed is more than 20 ($20 < Z$). If it is determined that this case (case 4) applies to a job, the controller 205 performs control such that creation of a saddle-stitched brochure without a square back can be inhibited in the job. In the case 4, the controller 205 performs control such that creation of a saddle-stitched brochure with a square back can also be inhibited.

In the management table 2100 in FIG. 21, minimum and maximum allowable numbers of sheets (lower and upper limit values of the number of sheets) per volume (brochure), which define a range where creation of a saddle-switched brochure of the first type is permitted, are set to 5 and 20, respectively. On the other hand, in the management table 2100, minimum and maximum allowable numbers of sheets (lower and upper limit values of the number of sheets) per volume (brochure), which define a range where creation of a saddle-switched brochure of the second type is permitted, are set to 1 and 15, respectively. These specific numerical values are only examples. However, it is to be understood that the minimum allowable number of sheets for creation of a saddle-switched brochure of the first type is set to a larger value than that associated with the saddle-switched brochure of the second type. On the other hand, it is preferable that the maximum allowable number of sheets for creation of a saddle-switched brochure of the second type is set to a smaller value than that associated with the saddle-switched brochure of the first type. It is preferable that the management table 2100 is configured such that the relationship in magnitude between the minimum and maximum allowable numbers of sheets associated with the first type of saddle-switched brochures and those associated with the second type of saddle-switched brochures can be preserved.

The printing system 1000 according to the present embodiment is configured to be capable of controlling whether to permit or inhibit creation of a saddle-stitched brochure of the first type and/or a saddle-stitched brochure of the second type not only according to the number of sheets, but also according to the type of sheets (media type). In this case, the controller 205 reads out rule information described in a management table 2200 shown in FIG. 22, and performs control based on the rule information. This management table 2200 manages rules as to whether to execute the aforementioned square back processing, by differentiating the rules according to selection candidates of a plurality kinds of sheets usable for printing by the printing apparatus and different in properties (thickness, basis weight, and glossiness).

In the management table 2200 in FIG. 22, sheets having the same attributes, such as ordinary paper and recycled paper, are classified as sheets of a first media type, and four rules are provided in association with the sheets of the first media type. Further, sheets thicker than the sheets of the first media type are classified as sheets of a second media type, and four rules are provided in association with the sheets of the second media type as well. Thus, in the management table 2200, rules concerning square back processing are defined on a media type-by-media type basis. The controller 205 reads out the rule information from the memory, as required, and performs control according to the rule information.

A description will be given of an operation performed in a case where the controller 205 performs control based on [Rule 1-1] in the management table 2200 in FIG. 22. Assume a case where a job to be processed requires less than 5 ($Z<5$) sheets of the first media type so as to create one printout. If it is determined that this case Z (case 1-1) applies to a job, the controller 205 performs control such that creation of a saddle-stitched brochure with a square back (i.e. a saddle-stitched brochure of the first type) can be inhibited in the job. In the case 1-1, however, the controller 205 permits creation of a saddle-stitched brochure without a square back (i.e. a saddle-stitched brochure of the second type) in the job.

Next, a description will be given of an operation performed in a case where the controller 205 performs control based on [Rule 1-2] in the management table 2200 in FIG. 22. Assume a case where a job to be processed requires not less than 5 and not more than 15 ($5 \leqq Z \leqq 15$) sheets of the first media type so as to create one printout. If it is determined that this case (case 1-2) applies to a job, the controller 205 permits creation of a saddle-stitched brochure with a square back in the job. In the case 1-2, the controller 205 also permits creation of a saddle-stitched brochure without a square back in the job.

Next, a description will be given of an operation performed in a case where the controller 205 performs control based on [Rule 1-3] in the management table 2200 in FIG. 22. Assume a case where a job to be processed requires more than 15 and not more than 20 ($15 \leqq Z \leqq 20$) sheets of the first media type so as to create one printout. If it is determined that this case (case 1-3) applies to a job, the controller 205 performs control such that creation of a saddle-stitched brochure without a square back in the job can be inhibited. In the case 1-3, however, the controller 205 permits creation of a saddle-stitched brochure with a square back in the job.

Next, a description will be given of an operation performed in a case where the controller 205 performs control based on [Rule 1-4] in the management table 2200 in FIG. 22. Assume a case where a job to be processed requires more than 20 ($20<Z$) sheets of the first media type so as to create one printout. If it is determined that this case (case 1-4) applies to a job, the controller 205 performs control such that creation of a saddle-stitched brochure without a square back in the job can be inhibited. In the case 1-4, the controller 205 performs control such that creation of a saddle-stitched brochure with a square back can also be inhibited in the job.

Next, a description will be given of an operation performed in a case where the controller 205 performs control based on [Rule 2-1] in the management table 2200 in FIG. 22. Assume a case where a job to be processed requires less than 3 ($Z<3$) sheets of the second media type so as to create one printout. If it is determined that this case 3 (case 2-1) applies to a job, the controller 205 performs control such that creation of a saddle-stitched brochure with a square back (i.e. a saddle-stitched brochure of the first type) in the job can be inhibited. In the case 2-1, however, the controller 205 permits creation of a saddle-stitched brochure without a square back (i.e. a saddle-stitched brochure of the second type) in the job.

Next, a description will be given of an operation performed in a case where the controller 205 performs control based on [Rule 2-2] in the management table 2200 in FIG. 22. Assume a case where a job to be processed requires not less than 3 and not more than 12 ($3 \leqq Z \leqq 12$) sheets of the second media type so as to create one printout. If it is determined that this case (case 2-2) applies to a job, the controller 205 permits creation of a saddle-stitched brochure with a square back in the job. In the case 2-2, the controller 205 also permits creation of a saddle-stitched brochure without a square back in the job.

Next, a description will be given of an operation performed in a case where the controller 205 performs control based on [Rule 2-3] in the management table 2200 in FIG. 22. Assume a case where a job to be processed requires more than 12 and not more than 18 ($12<Z \leqq 18$) sheets of the second media type so as to create one printout. If it is determined that this case (case 2-3) applies to a job, the controller 205 performs control such that creation of a saddle-stitched brochure without a square back in the job can be inhibited. In the case 2-3, however, the controller 205 permits creation of a saddle-stitched brochure with a square back in the job.

Next, a description will be given of an operation performed in a case where the controller 205 performs control based on [Rule 2-4] in the management table 2200 in FIG. 22. Assume a case where a job to be processed requires more than 18 ($18<Z$) sheets of the second media type so as to create one printout. If it is determined that this case (case 2-4) applies to a job, the controller 205 performs control such that creation of a saddle-stitched brochure without a square back can be inhibited in the job. In the case 2-4, the controller 205 performs control such that creation of a saddle-stitched brochure with a square back can also be inhibited in the job.

It should be noted that in the management table 2200 in FIG. 22, the specific numerical values corresponding, respectively, to the media type-specific minimum and maximum allowable numbers of sheets for creation of one first-type saddle-stitched brochure and those for creation of one second-type saddle-stitched brochure are set only by way of example. However, similarly to the FIG. 21 management table, it is preferred that the relationship in magnitude between the specific numerical values associated with the first type of saddle-stitched brochures and those associated with the second type of saddle-stitched brochures can be preserved. For example, in the management table 2200 in FIG. 22, the minimum and maximum allowable numbers of sheets for creation of one first-type saddle-stitched brochure in a case where sheets of the first media type are used for printing by the printing apparatus 100 are set to 5 and 20, respectively, while those in a case where sheets of the second media type are used are set to 3 and 18, respectively. As shown in this example, the minimum and maximum allowable numbers of sheets for creation of one first-type saddle-stitched brochure in the case where sheets of the second media type are used for printing by the printing apparatus 100 are set to smaller values than in the case where sheets of the first media type are used for printing by the printing apparatus 100.

Similarly, in the management table 2200 in FIG. 22, the minimum and maximum allowable numbers of sheets for creation of one second-type saddle-stitched brochure in a case where sheets of the first media type are used for printing by the printing apparatus 100 are set to 1 and 15, respectively, while those in a case where sheets of the second media type are used are set to 1 and 12, respectively. As shown in this example, it is preferred that the minimum and maximum allowable numbers of sheets for creation of one second-type saddle-stitched brochure in the case where sheets of the second media type are used for printing by the printing apparatus 100 are also set to smaller values than in the case where sheets of the first media type are used for printing by the printing apparatus 100. It is preferable that the management table 2200 is FIG. 22 is configured according to such rules.

Thus, there is provided a configuration which makes it possible to achieve fine-grained control also considering the thickness of media used for creation of printout. This enables advantageous effects of the present embodiment to be further improved.

According to the present embodiment, the controller 205 is capable of performing not only above-described [Control 1] to [Control 8], but also [Control 9] to [Control 16] described below.

[Control 9] Assume a case where a job to be processed by the printing system 1000 requires a number of sheets of the first media type not more in number than a first predetermined number of sheets allowable in creating one printout in creating a saddle-stitched brochure of the aforementioned first type. Referring to FIG. 22, this case includes a job requiring not more than 15 sheets of the first media type. If it is determined that this case applies to a job, the controller 205 permits the printing system 1000 to create a saddle-stitched brochure of the second type for the job, using sheets of the first media type. Assume, on the other hand, a case where a job to be processed by the printing system 1000 requires a number of sheets of the first media type more in number than the first predetermined number of sheets so as to create one printout. Referring to FIG. 22, this case includes a job requiring more than 15 sheets of the first media type so as to create one printout. If it is determined that this case applies to a job, the controller 205 inhibits the printing system 1000 from creating a saddle-stitched brochure of the second type for the job, using sheets of the first media type.

Further, assume a case where a job to be processed by the printing system 1000 requires sheets of the second media type each larger in thickness than each sheet of the first media type sheet and different in type from the same so as to create one printout, and the number of the sheets of the second media type required for the job is not more than a second predetermined number set to be less than the first predetermined number. Referring to FIG. 22, this case includes a job requiring not more than 12 sheets of the second media type so as to create one printout. If it is determined that this case applies to a job, the controller 205 permits the printing system 1000 to create a saddle-stitched brochure of the second type for the job, using sheets of the second media type. Assume, on the other hand, a case where a job to be processed by the printing system 1000 requires a number of sheets of the second media type more in number than the second predetermined number of sheets so as to create one printout. Referring to FIG. 22, this case includes a job requiring more than 12 sheets of the second media type so as to create one printout. If it is determined that this case applies to a job, the controller 205 inhibits the printing system 1000 from creating a saddle-stitched brochure of the second type for the job, using sheets of the second media type.

[Control 10] Assume a case where a job to be processed by the printing system 1000 requires a number of sheets of the first media type not less in number than a first predetermined number of sheets allowable in creating a saddle-stitched brochure of the second type so as to create one printout. Referring to FIG. 22, this case includes a job requiring not less than 5 and not more than 20 sheets of the first media type so as to create one printout. If it is determined that this case applies to a job, the controller 205 permits the printing system 1000 to create a saddle-stitched brochure of the first type for the job, using sheets of the first media type. Assume, on the other hand, a case where a job to be processed by the printing system 1000 requires a number of sheets of the first media type less in number than the first predetermined number of sheets so as to create one printout. Referring to FIG. 22, this case includes a job requiring less than 5 sheets of the first media type so as to create one printout. If it is determined that this case applies to a job, the controller 205 inhibits the printing system 1000 from creating a saddle-stitched brochure of the first type for the job, using sheets of the first media type.

Further, assume a case where a job to be processed by the printing system 1000 requires a number of sheets of the second media type not less in number than a second predetermined number set to be less than the first predetermined number. Referring to FIG. 22, this case includes a job requiring not less than 3 and not more 18 sheets of the second media type so as to create one printout. If it is determined that this case applies to a job, the controller 205 permits the printing system 1000 to create a saddle-stitched brochure of the first type for the job, using sheets of the second media type. Assume, on the other hand, a case where a job to be processed by the printing system 1000 requires a number of sheets of the second media type less in number than the second predetermined number of sheets so as to create one printout. Referring to FIG. 22, this case includes a job requiring less than 3 sheets of the second media type so as to create one printout. If it is determined that this case applies to a job, the controller 205 inhibits the printing system 1000 from creating a saddle-stitched brochure of the first type for the job, using sheets of the second media type.

[Control 11] Assume a case where a job to be processed by the printing system 1000 requires a number of sheets of the first media type less in number than a first predetermined number of sheets allowable in creating a saddle-stitched brochure of the aforementioned first type so as to create one printout. Referring to FIG. 22, this case includes a job requiring not more than 15 sheets of the first media type so as to create one printout. If it is determined that this case applies to a job, the controller 205 permits the printing system 1000 to create a saddle-stitched brochure of the second type for the job, using sheets of the first media type. Assume, on the other hand, a case where a job to be processed by the printing system 1000 requires a number of sheets of the first media type more in number than the first predetermined number of sheets so as to create one printout. Referring to FIG. 22, this case includes a job requiring more than 15 and not more 20 sheets of the first media type so as to create one printout. If it is determined that this case applies to a job, the controller 205 performs control such that the printing system 1000 is inhibited from creating a saddle-stitched brochure of the second type for the job, using sheets of the first media type. In this case, however, the controller 205 performs control such that the printing system 1000 is permitted to create a saddle-stitched brochure of the first type for the job, using sheets of the first media type.

Further, assume a case where a job to be processed by the printing system 1000 requires a number of sheets of the second media type not more in number than the second predetermined number set to be smaller than the first predetermined number. Referring to FIG. 22, this case includes a job requiring not more than 12 sheets of the second media type. If it is determined that this case applies to a job, the controller 205 permits the printing system 1000 to create a saddle-stitched brochure of the second type for the job, using sheets of the second media type. Assume, on the other hand, a case where a job to be processed by the printing system 1000 requires a number of sheets of the second media type more in number than the second predetermined number of sheets so as to create one printout. Referring to FIG. 22, this case includes a job requiring more than 12 and not more than 18 sheets of the second media type so as to create one printout. If it is determined that this case applies to a job, the controller 205 controls the printing system 1000 such that the printing system 1000 is inhibited from creating a saddle-stitched brochure of the second type for the job, using sheets of the second media type. In this case, however, the controller 205 controls the printing system 1000 such that the printing system 1000 is permitted to create a saddle-stitched brochure of the first type for the job, using sheets of the second media type.

[Control 12] Assume a case where a job to be processed by the printing system 1000 requires a number of sheets of the first media type not less in number than the first predetermined number of sheets allowable in creating a saddle-stitched brochure of the aforementioned second type so as to create one printout. Referring to FIG. 22, this case includes a job requiring not less than 5 and not more than 20 sheets of the first media type. If it is determined that this case applies to a job, the controller 205 permits the printing system 1000 to create a saddle-stitched brochure of the first type for the job, using sheets of the first media type. Assume, on the other hand, a case where a job to be processed by the printing system 1000 requires a number of sheets of the first media type less in number than the first predetermined number of sheets so as to create one printout. Referring to FIG. 22, this case includes a job requiring less than 5 sheets of the first media type so as to create one printout. If it is determined that this case applies to a job, the controller 205 controls the printing system 1000 such that the printing system 1000 is permitted to create a saddle-stitched brochure of the second type for the job, using sheets of the first media type, without creating a saddle-stitched brochure of the first type.

Further, assume a case where a job to be processed by the printing system 1000 requires a number of sheets of the second media type not less in number than the second predetermined number set to be smaller than the first predetermined number. Referring to FIG. 22, this case includes a job requiring not less than 3 and not more 18 sheets of the second media type so as to create one printout. If it is determined that this case applies to a job, the controller 205 controls the printing system 1000 such that the printing system 1000 is permitted to create a saddle-stitched brochure of the first type for the job, using sheets of the second media type. Assume, on the other hand, a case where a job to be processed by the printing system 1000 requires a number of sheets of the second media type less in number than the second predetermined number of sheets so as to create one printout. Referring to FIG. 22, this case includes a job requiring less than 3 sheets of the second media type so as to create one printout. If it is determined that this case applies to a job, the controller 205 controls the printing system 1000 such that the printing system 1000 is inhibited from creating a saddle-stitched brochure of the first type for the job, using sheets of the second media type. In this case, however, the controller 205 controls the printing system 1000 such that the printing system 1000 is permitted to create a saddle-stitched brochure of the second type for the job, using sheets of the second media type.

[Control 13] Assume a case where a job to be processed by the printing system 1000 requires a number of sheets of the first media type not less in number than the first number and not more in number than the second number set to be more than the first number so as to create one printout. Referring to FIG. 22, this case includes a job requiring not less than 5 and not more than 15 sheets of the first media type so as to create one printout. If it is determined that this case applies to a job, the controller 205 permits the printing system 1000 to create a saddle-stitched brochure of the second type for the job, using sheets of the first media type. Assume, on the other hand, a case where a job to be processed by the printing system 1000 requires a number of sheets of the first media type more in number than the second number of sheets so as to create one printout. Referring to FIG. 22, this case includes a job requiring more than 15 sheets of the first media type so as to create one printout. If it is determined that this case applies to a job, the controller 205 inhibits the printing system 1000 from creating a saddle-stitched brochure of the second type for the job, using sheets of the first media type.

Further, assume a case where a job to be processed by the printing system 1000 requires a number of sheets of the second media type not less in number than a third number of sheets set to be less in number than the first number of sheets and not more than a fourth number of sheets set to be less in number than the second number of sheets so as to create one printout. Referring to FIG. 22, this case includes a job requiring not less than 3 and not more than 12 sheets of the second media type so as to create one printout. If it is determined that this case applies to a job, the controller 205 permits the printing system 1000 to create a saddle-stitched brochure of the second type for the job, using sheets of the second media type. Assume, on the other hand, a case where a job to be processed by the printing system 1000 requires a number of sheets of the second media type more in number than the fourth number of sheets so as to create one printout. Referring to FIG. 22, this case includes a job requiring more than 12 sheets of the second media type so as to create one printout. If it is determined that this case applies to a job, the controller 205 inhibits the printing system 1000 from creating a saddle-stitched brochure of the second type for the job, using sheets of the second media type.

[Control 14] Assume a case where a job to be processed by the printing system 1000 requires a number of sheets of the first media type not less in number than the first number and not more in number than the second number set to be more than the first number so as to create one printout. Referring to FIG. 22, this case includes a job requiring not less than 5 and not more than 20 sheets of the first media type so as to create one printout. If it is determined that this case applies to a job, the controller 205 permits the printing system 1000 to create a saddle-stitched brochure of the first type for the job, using sheets of the first media type. Assume, on the other hand, a case where a job to be processed by the printing system 1000 requires a number of sheets of the first media type less in number than the first number of sheets so as to create one printout. Referring to FIG. 22, this case includes a job requiring less than 5 sheets of the first media type so as to create one printout. If it is determined that this case applies to a job, the controller 205 inhibits the printing system 1000 from creating a saddle-stitched brochure of the first type for the job, using sheets of the first media type.

Further, assume a case where a job to be processed by the printing system 1000 requires a number of sheets of the second media type not less in number than the third number of sheets set to be less than the first number of sheets and not more than the fourth number of sheets set to be less than the second number of sheets so as to create one printout. Referring to FIG. 22, this case includes a job requiring not less than 3 and not more 18 sheets of the second media type so as to create one printout. If it is determined that this case applies to a job, the controller 205 permits the printing system 1000 to create a saddle-stitched brochure of the first type for the job, using sheets of the second media type.

Assume, on the other hand, a case where a job to be processed by the printing system 1000 requires a number of sheets of the second media type less in number than the third number of sheets so as to create one printout. Referring to FIG. 22, this case includes a job requiring less than 3 sheets of the second media type so as to create one printout. If it is determined that this case applies to a job, the controller 205 inhibits the printing system 1000 from creating a saddle-stitched brochure of the first type for the job, using sheets of the second media type.

[Control 15] Assume a case where a job to be processed by the printing system 1000 requires a number of sheets of the first media type not less in number than the first number and not more in number than the second number set to be more than the first number so as to create one printout. Referring to FIG. 22, this case includes a job requiring not less than 5 and not more than 15 sheets of the first media type. If it is determined that this case applies to a job, the controller 205 controls the printing system 1000 such that the printing system 1000 is permitted to create a saddle-stitched brochure of the second type for the job, using sheets of the first media type. Assume, on the other hand, a case where a job to be processed by the printing system 1000 requires a number of sheets of the first media type more in number than the second number of sheets so as to create one printout. Referring to FIG. 22, this case includes a job requiring more than 15 and not more than 20 sheets of the first media type so as to create one printout. If it is determined that this case applies to a job, the controller 205 controls the printing system 1000 such that the printing system 1000 is inhibited from creating the second-type saddle-stitched brochure for the job, using sheets of the first media type. In this case, however, the controller 205 controls the printing system 1000 such that the printing system 1000 is permitted to create a saddle-stitched brochure of the first type for the job, using sheets of the first media type.

Assume a case where a job to be processed by the printing system 1000 requires sheets of the second media type not less in number than the third number of sheets set to be less than the first number of sheets and not more in number than the fourth number of sheets set to be less than the second number of sheets so as to create one printout. Referring to FIG. 22, this case includes a job requiring not less than 3 and not more than 12 sheets of the second media type so as to create one printout. If it is determined that this case applies to a job, the controller 205 controls the printing system 1000 such that the printing system 1000 is permitted to create a saddle-stitched brochure of the second type for the job, using sheets of the second media type. Assume, on the other hand, a case where a job to be processed by the printing system 1000 requires a number of sheets of the second media type more in number than the fourth number so as to create one printout. Referring to FIG. 22, this case includes a job requiring more than 12 and not more than 18 sheets of the second media type so as to create one printout. If it is determined that this case applies to a job, the controller 205 controls the printing system 1000 such that the printing system 1000 is inhibited from creating a saddle-stitched brochure of the second type for the job, using sheets of the second media type. In this case, however, the controller 205 controls the printing system 1000 such that the printing system 1000 is permitted to create a saddle-stitched brochure of the first type for the job, using sheets of the second media type.

[Control 16] Assume a case where a job to be processed by the printing system 1000 requires a number of sheets of the first media type not less in number than the first number and not more in number than the second number set to be more than the first number so as to create one printout. Referring to FIG. 22, this case includes a job requiring not less than 5 and not more than 15 sheets of the first media type so as to create one printout. If it is determined that this case applies to a job, the controller 205 controls the printing system 1000 such that the printing system 1000 is permitted to create a saddle-stitched brochure of the first type for the job, using sheets of the first media type. Assume, on the other hand, a case where a job to be processed by the printing system 1000 requires a number of sheets of the first media type less in number than the first number of sheets so as to create one printout. Referring to FIG. 22, this case includes a job requiring less than 5 sheets of the first media type so as to create one printout. If it is determined that this case applies to a job, the controller 205 controls the printing system 1000 such that the printing system 1000 is inhibited from creating a saddle-stitched brochure of the first type for the job, using sheets of the first media type. In this case, however, the controller 205 controls the printing system 1000 such that the printing system 1000 is permitted to create a saddle-stitched brochure of the second type for the job, using sheets of the first media type.

Assume a case where a job to be processed by the printing system 1000 requires a number of sheets of the second type not less in number than the third number of sheets set to be less than the first number of sheets and not more in number than the fourth number of sheets set to be less than the second number of sheets so as to create one printout. Referring to FIG. 22, this case includes a job requiring not less than 3 and not more than 12 sheets of the second media type so as to create one printout. If it is determined that this case applies to a job, the controller 205 controls the printing system 1000 such that the printing system 1000 is permitted to create a saddle-stitched brochure of the first type for the job, using sheets of the second media type. Assume, on the other hand, a case where a job to be processed by the printing system 1000 requires a number of sheets of the second media type less in number than the third number of sheets so as to create one printout. Referring to FIG. 22, this case includes a job requiring less than 3 sheets of the second media type so as to create one printout. If it is determined that this case applies to a job, the controller 205 controls the printing system 1000 such that the printing system 1000 is inhibited from creating a saddle-stitched brochure of the first type for the job, using sheets of the second media type. In this case, however, the controller 205 controls the printing system 1000 such that the printing system 1000 is permitted to create a saddle-stitched brochure of the second type for the job, using sheets of the second media type.

As described above, the printing system 1000 is configured to be capable of controlling whether to permit or inhibit creation of a saddle-stitched brochure of the first type and/or a saddle-stitched brochure of the second type not only based on the number of sheets required to be printed as one set for a job to be processed, but also based on a type of the sheets.

The above-described [Control 10], [Control 12], [Control 14], and [Control 16] basically restrict creation of a saddle-stitched brochure of the first type, and therefore they correspond to developed forms of the aforementioned first control. On the other hand, the above-described [Control 9], [Control 11], [Control 13], and [Control 15] basically restrict creation of a saddle-stitched brochure of the second type, and therefore they correspond to developed forms of the above-described second control. In the present embodiment, these two kinds of control are executed in association with each job to be processed, i.e. on a job-by-job basis.

Further, as in the cases of [Control 1] to [Control 16], the controller 205 performs control such that creation of a saddle-stitched brochure of the first type or a saddle-stitched brochure of the second type is inhibited based on the number and/or type of sheets required to be printed as one set for a job to be processed. In the present embodiment, as a configuration for achieving this control, the controller 205 controls a user interface (hereinafter simply referred to as "the UI") to display a display screen including a warning message and/or a display screen configured to be capable of accepting reconfiguration of processing conditions from the operator. In the present embodiment, as another configuration for achieving the control, the controller 205 performs control such that execution of square back processing for the job by the square back-forming section 23 appearing in FIG. 4 is canceled. Further, in the present embodiment, as still another configuration for achieving the control, the controller 205 performs control such that execution of saddle-stitch processing for the job by the saddle stitcher 28 appearing in FIG. 4 is canceled. Furthermore, in the present embodiment, as still another configuration for achieving the control, the controller 205 performs control such that execution of print processing for the job by the printer section 203 is canceled. It should be noted that the controller 205 may execute all the above-mentioned control operations or an optionally selected at least one of them. Each cancellation processing in the job is executed by the controller 205 in response to a cancellation instruction input by the operator via the UI. In a description given hereinafter, this configuration is adopted by way of example, but a different configuration may be adopted as well. For example, a configuration may be adopted in which each cancellation processing is automatically executed based on a result of an associated one of the aforementioned various determinations made by the controller 205, even when an associated cancellation instruction is not input by the operator.

The printing system 1000 according to the present embodiment is also provided with configurations described below.

It is assumed that the number of sheets required to be printed as one set for a job to be processed by the printing system 1000 according to the present embodiment exceeds the maximum allowable number per volume in creating the aforementioned saddle-stitched brochure with a square back. In this case, even if it is determined that the maximum allowable number is exceeded, the controller 205 performs control, without canceling processing for the job to be processed, such that a plurality of saddle-stitched brochures, each having a square back, which correspond to respective separate or divided volumes of one saddle-stitched brochure can be created. In the present embodiment, the processing of the job to be processed is square back processing, for example.

Let it be assumed that a job to be processed in response to a request issued by the operator for execution of saddle-stitch processing including square back processing requires a total of 24 sheets to be printed as one set. In this case, the controller 205 refers to the management table 2100 in FIG. 21 and determines that the number of the sheets is out of an allowable range of numbers of sheets which can be set for one volume of saddle-stitched brochure with a square back. In the management table 2100 in FIG. 21, the allowable number of sheets for one volume of saddle-stitched brochure with a square back is set to 5 sheets at the minimum and 20 sheets at the maximum.

Based on the determination that the number of the sheets is out of the allowable range of numbers of sheets, the controller 205 controls the printing system 1000 to create two saddle-stitched brochures of the first type for separating the originally intended saddle-stitched brochure into separate volumes (volume separation processing), each formed as a 12-sheet bundle, as products corresponding to one saddle-stitched brochure of 24 sheets. It should be noted that in a case where the volume separation processing is executed, bookbinding layout (imposition) for separate-volume brochures is performed such that each separate-volume brochure can have serial pages. Further, in the case of performing volume separation processing, the controller 205 determines the number of brochures for volume separation such that the number of sheets forming each of the separate-volume brochures falls within an allowable range of numbers of sheets for square back processing of one volume (brochure). For example, the management table 2100 in FIG. 21 prescribes that square back processing should be inhibited in creating a saddle-stitched brochure from a sheet bundle formed by less than 5 sheets. Therefore, in the case of performing the volume separation processing, the controller 205 performs control such that a volume separation for creating separate-volume brochures each formed by less than 5 sheets is inhibited. The printing system 1000 may be configured such that whether or not to shift to an operation mode for creating separate-volume brochures as saddle-stitched brochures of the first type can be selectively determined by the operator via the UI displaying a screen described hereinafter with reference to FIG. 13, or alternatively, the printing system 1000 may be configured such that whether or not to shift to the operation mode can be automatically determined by the controller 205. Further, the printing system 1000 is configured to be capable of performing not only the above-described control, but also the following control:

Let it be assume that the number of sheets required to be printed as one set for a job to be processed by the printing system 1000 according to the present embodiment is more than the maximum allowable number per volume in creating a saddle-stitched brochure without square back processing. In this case, even if it is determined that the maximum allowable number is exceeded, the controller 205 performs control, without canceling processing (print processing and saddle-stitch processing) for the job, such that a plurality of square-backed saddle-stitched brochures which correspond to respective separate or divided volumes of one saddle-stitched brochure can be created. For example, it is assumed that a job to be processed in response to a request issued by the operator for execution of saddle-stitch processing without square back processing requires a total of 20 sheets to be printed as one set. In this case, the controller 205 determines that the number of the sheets is out of an allowable range of numbers of sheets which can be set for one volume of saddle-stitched brochure without a square back. In the management table 2100 in FIG. 21, the allowable number of sheets for one volume of saddle-stitched brochure without a square back is set to 1 sheet at the minimum and 15 sheets at the maximum.

Based on the determination that the number of the sheets is out of the allowable range of numbers of sheets, the controller 205 controls the printing system 1000 to create two saddle-stitched brochures of the first type as separate volumes, each formed by 10 sheets, as products corresponding to one saddle-stitched brochure of 20 sheets. In a case where the volume separation processing is executed, bookbinding layout (imposition) for separate-volume brochures is performed such that each separate-volume brochure can have serial pages. Further, in the case of performing volume separation processing, the controller 205 determines the number of brochures for volume separation such that the number of sheets forming each of the separate-volume brochures falls within the allowable range of numbers of sheets set for square back processing for one volume. It should be noted that the printing system 1000 may be configured such that whether or not to shift to the operation mode can be selectively determined by the operator via the UI displaying a screen described hereinafter with reference to FIG. 19, or alternatively, the printing system 1000 may be configured such that whether or not to shift to the operation mode can be automatically determined by the controller 205.

In the following description, the printing system 1000 is configured, by way of example, such that the controller 205 accepts a request for creating a saddle-stitched brochure of the aforementioned first type and/or a saddle-stitched brochure of the second type from the operator via the UI of the printing apparatus 100. Further, the controller 205 is provided in the printing apparatus 100. However, the printing system 1000 may be configured differently from the example. For example, the controller 205 may accept a request for creating a saddle-stitched brochure of the first type and/or a saddle-stitched brochure of the second type from the operator via a UI of an external device (e.g. the PC 103 or 104) which can perform data communication with the printing apparatus 100 via the network. Further, a configuration may be adopted in which the above-described various kinds of control are executed not by the controller 205, but by a controller, not shown, provided in an external device (e.g. the PC 103 or 104) which can perform data communication with the printing apparatus 100 via the network.

Next, a description will be given of an example of the application of the first control and the second control as various capabilities of the printing system 1000 according to the present embodiment. In the following, a case where control based on the management table 2100 in FIG. 21 is executed by the controller 205 will be taken as an example. However, control based on the management table 2200 in FIG. 22 can also be practiced with a configuration equivalent to the configuration described below.

First, a description will be given of necessity of restriction of creation of a saddle-stitched brochure of the second type, which is practiced based on the aforementioned second control. Prior to the description, differences between a case where square back processing is executed and a case where square back processing is not executed will be described with reference to FIGS. 10A to 10D.

Figure 10A:
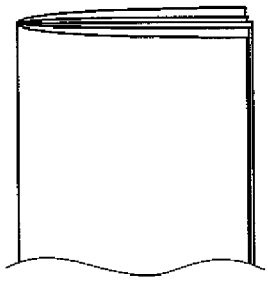
FIG. 10A is a perspective view of the appearance of a saddle-stitched brochure formed by a set of a smaller number of sheets.
Figure 10B:
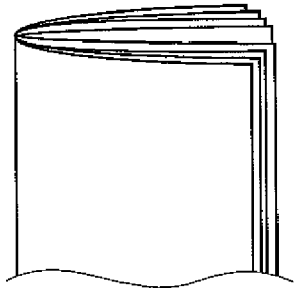
FIG. 10B is a perspective view of the appearance of a saddle-stitched brochure formed by a set of a larger number of sheets.

FIG. 10A is a perspective view of the appearance of a saddle-stitched brochure formed by a set of a smaller number of sheets, while FIG. 10B is a perspective view of the appearance of a saddle-stitched brochure formed by a set of a larger number of sheets. It should be noted that the saddle-stitched brochures in FIGS. 10A and 10B have not undergone square back processing. As is apparent from comparison between FIG. 10A and FIG. 10B, when the number of sheets is large, a saddle-stitched brochure has an arcuate bulge as a portion of a sheet bundle extending from the back thereof toward the front end (fore edge part) thereof.

Figure 10C:
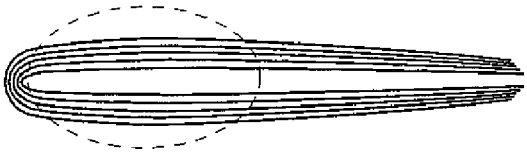
FIG. 10C is a cross-sectional view of a saddle-stitched brochure not subjected to square back processing.
Figure 10D:
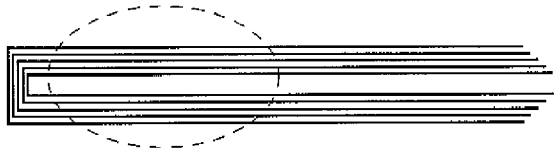
FIG. 10D is a cross-sectional view of a saddle-stitched brochure subjected to square back processing.

On the other hand, FIG. 10C is a cross-sectional view of a saddle-stitched brochure not subjected to square back processing (i.e. a saddle-stitched brochure of the second type), while FIG. 10D is a cross-sectional view of a saddle-stitched brochure subjected to square back processing (i.e. a saddle-stitched brochure of the first type). As is apparent from comparison between FIG. 10C and FIG. 10D, in a saddle-stitched brochure not subjected to square back processing, a portion enclosed by a dotted circle bulges, whereas in a saddle-stitched brochure subjected to square back processing, a portion enclosed by a dotted circle does not bulge, and a back thereof is flattened. In a case where the number of sheets used as one set for creating a saddle-stitched brochure is very large, if creation of a saddle-stitched brochure of the second type is inadvertently created, a saddle-stitched brochure having a back thereof very bulging and hence defective in appearance and/or stackability can be created unintentionally. In other words, depending on the number and type of sheets of a saddle-stitched brochure to be processed (i.e. the thickness of one volume), execution of square back processing can improve the appearance and stackability of the printout. In view of this point, according to the present embodiment, the aforementioned second control is configured to make it possible to suppress occurrence of the above-mentioned drawbacks. Based on this fact, an application of the second control will be described below.

In particular, in the present example, control is performed such that the advantage of a saddle-stitched brochure with a square back can be favorably utilized by restricting creation of a saddle-stitched brochure without a square back. This will be described basically with reference to FIG. 11 etc. It should be noted that in the present embodiment, the controller 205 controls the touch panel section 401 of the operating section 204 to display various kinds of screens, described hereafter, in response to respective various triggers exemplified below.

Figure 11:
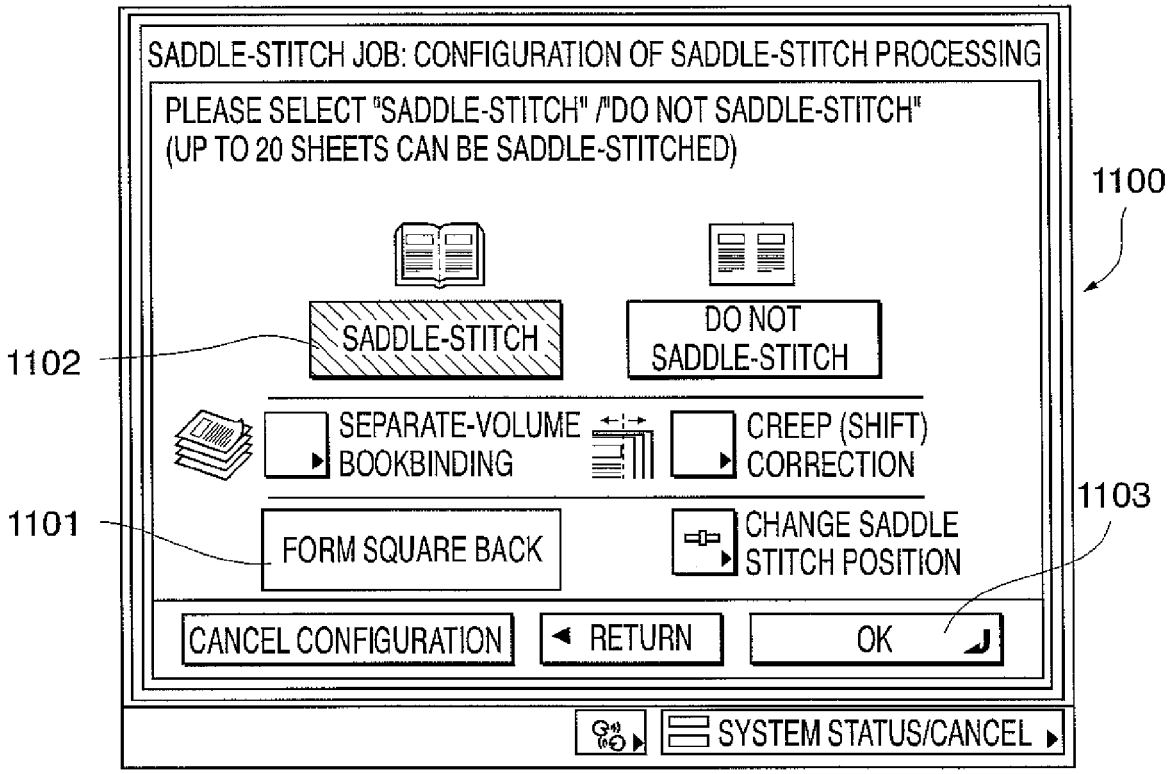
FIG. 11 is a view showing an example of a saddle-stitch job configuration screen which is displayed on a touch panel section.

FIG. 11 is a view showing an example of a saddle-stitch job configuration screen which the controller 205 causes the touch panel section 401 to display in response to depression of a saddle-stitch mode key 705 by the operator.

The printing system 1000 according to the present embodiment is configured such that the operator can configure settings as to whether or not to execute saddle-stitch processing, settings for separate-volume bookbinding, settings for trimming, settings for adjustment of saddle-stitching positions, and so forth, via a saddle-stitch job configuration screen 1100 shown in FIG. 11. This saddle-stitch job configuration screen 1100 is configured to display a "Form square back" button 1101 to be used by the operator to give an instruction for executing square back processing for a saddle-stitch job to be processed. When the operator presses the start key 503 after configuring various settings required for creating a saddle-stitched brochure, the controller 205 accepts an instruction for executing the saddle-stitch job. Then, the controller 205 controls the printing system 1000 to process the saddle-stitch job according to the saddle-stitch job execution instruction from the operator.

It should be noted that the operator can input an instruction for executing saddle-stitch processing by pressing a "saddle-stitch" button 1102 on the saddle-stitch job configuration screen 1100. Further, the operator can input an instruction for executing square back processing in the job by pressing the "Form square back" button 1101 on the saddle-stitch job configuration screen 1100. On condition that the operator inputs these two instructions in an operation for configuring print processing conditions, the controller 205 determines that the associated job is a saddle-stitch job and a first-type job requiring square back processing. As a consequence, the controller 205 causes the printing system 1000 to create a saddle-stitched brochure of the first type having undergone square back processing so as to have a flat surface formed in its back stitched at two locations and folded in half in the job.

Let it be assumed, on the other hand, that the operator inputs the instruction for executing saddle-stitch processing by pressing the "Saddle-stitch" button 1102 on the saddle-stitch job configuration screen 1100, and then presses the start key 503 without inputting the instruction for executing square back processing by pressing the "Form square back" button 1101. In this case, the controller 205 determines that the job is a saddle-stitch job and at the same time a second-type job not requiring square back processing. As a consequence, the controller 205 causes the printing system 1000 to create a saddle-stitched brochure of the second type having no flat surface formed in its back stitched at two locations and folded in half in the job.

A series of processes required for creating the above-described saddle-stitched brochure will be described with reference to FIG. 14.

Figure 14:
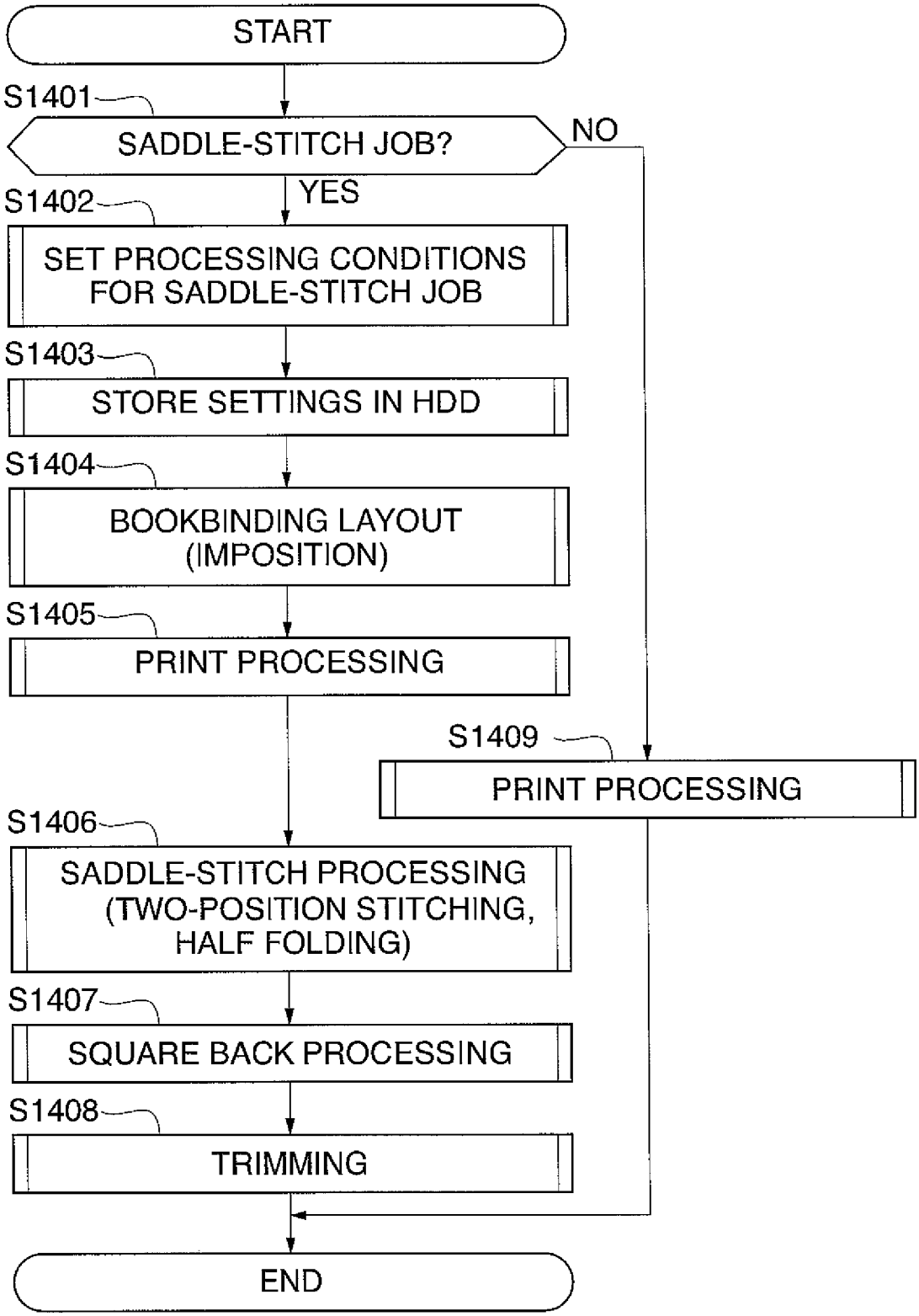
FIG. 14 is a flowchart of a printing process including saddle-stitch processing.

FIG. 14 is a flowchart of a printing process including saddle-stitch processing. The present process is executed by the controller 205 based on predetermined programs read out from the memory.

First, the controller 205 determines, e.g. based on whether or not the saddle-stitch mode key 705 has been pressed, whether or not a job to be processed is a saddle-stitch job (S1401). If the job is not a saddle-stitch job (i.e. if the job is the aforementioned stacker job or glue binding job), print processing and sheet processing required for the job are carried out in a step S1409. On the other hand, if the job is a saddle-stitch job, the controller 205 causes the touch panel section 404 to display the saddle-stitch job configuration screen 1100, and accepts various settings from the operator (S1402).

When the settings are completely configured (i.e. when an "OK" button 1103 appearing in FIG. 11 is pressed) and then the start key 503 is pressed, the controller 205 determines that an instruction for starting the job has been accepted. As a consequence, in a step S1403, all pages of print data for the job are stored in the HDD 209.

Next, the controller 205 performs bookbinding layout (imposition) of print data for the job, which is stored in the HDD 209, based on the settings accepted in the step S1402 (S1404). Thereafter, the print data having undergone the bookbinding layout is printed by the printing apparatus 100 (S1405), and then saddle-stitch processing (two-position saddle stitching and half folding performed on a portion corresponding to the back of a saddle-stitched brochure) is executed by the saddle stitcher 28 (S1406). The processes executed in the steps S1404 to S1406 were already described in detail with reference to FIGS. 8A to 8D and 9A and 9B, and therefore description thereof is omitted.

Then, if the controller 205 determines that the Job is of the first type, it causes the square back-forming section 23 to perform square back processing on a sheet bundle which is saddle-stitched in the step S1406 (S1407). It should be noted that if the controller 205 determining that the job is of the second type, it skips the step S1407 (i.e. square back processing). Thereafter, if trimming is designated, the cutter section 30 is caused to perform trimming according to the settings accepted from the operator (S1408). In the end, the printout is conveyed to the booklet holding section 31 to be held therein. Through the above-described sequence, a saddle-stitched brochure of the first type or a saddle-stitched brochure of the second type is created by the printing system 1000.

In the present embodiment, at a time point when all pages of print data (i.e. print data to be subjected to bookbinding layout) for a job to be subjected to saddle-stitch processing is stored in the HDD 209, the controller 205 starts to perform both the first control and the second control. More specifically, various control operations including [Control 1] to [Control 16] described hereinabove are executed by the controller 205 in the timing of execution of the step S1404. In this respect, various changes and modifications can be made, but the first control and the second control have to be executed before print processing for a job to be subjected to saddle-stitch processing is started in the step S1405. Thus, when creation of a saddle-stitched brochure of the first type or a saddle-stitched brochure of the second type is inhibited in a job to be processed, it is possible to cancel execution of saddle-stitch processing or print processing before they are actually performed in the system.

Further, the controller 205 confirms the total number of pages of print data of unedited originals, which is stored in the HDD 209, and determines the number of sheets required to be printed as one set for one saddle-stitched brochure for the job based on the total number. For example, let it be assumed that the number of pages of print data of originals which is input for a job to be subjected to saddle-stitch processing is 60 (pages). As shown in FIGS. 8A to 8D, in layout processing for a saddle-stitched brochure, two pages are laid out on each of the front and reverse sides of each recording sheet. In other words, image data of four pages is laid out per recording sheet. Accordingly, in this case, the number of sheets required, in a job, as one set for a saddle-stitched brochure can be calculated as "60/4=15 (sheets)". This method of obtaining the number of sheets required in a job is not limitative. For example, a method may be employed in which the controller 205 can directly confirm the number of sheets required as one set for saddle-stitched brochure, based on information described in a job ticket attached as job data of a job to be processed, together with the print data. Of course, a configuration may be adopted in which the controller 205 executes the various control operations according to the present embodiment, using page count information as it is without converting the same into sheet count information.

Further, in a job to be processed in the present embodiment, image data to be printed may be input from the scanner 201 or via the external I/F 202. In the former case, a configuration may be adopted in which the number of sheets required in the job as one set for a printout is confirmed based on original sheet count information counted by the ADF provided in the scanner section 201.

Figure 12:
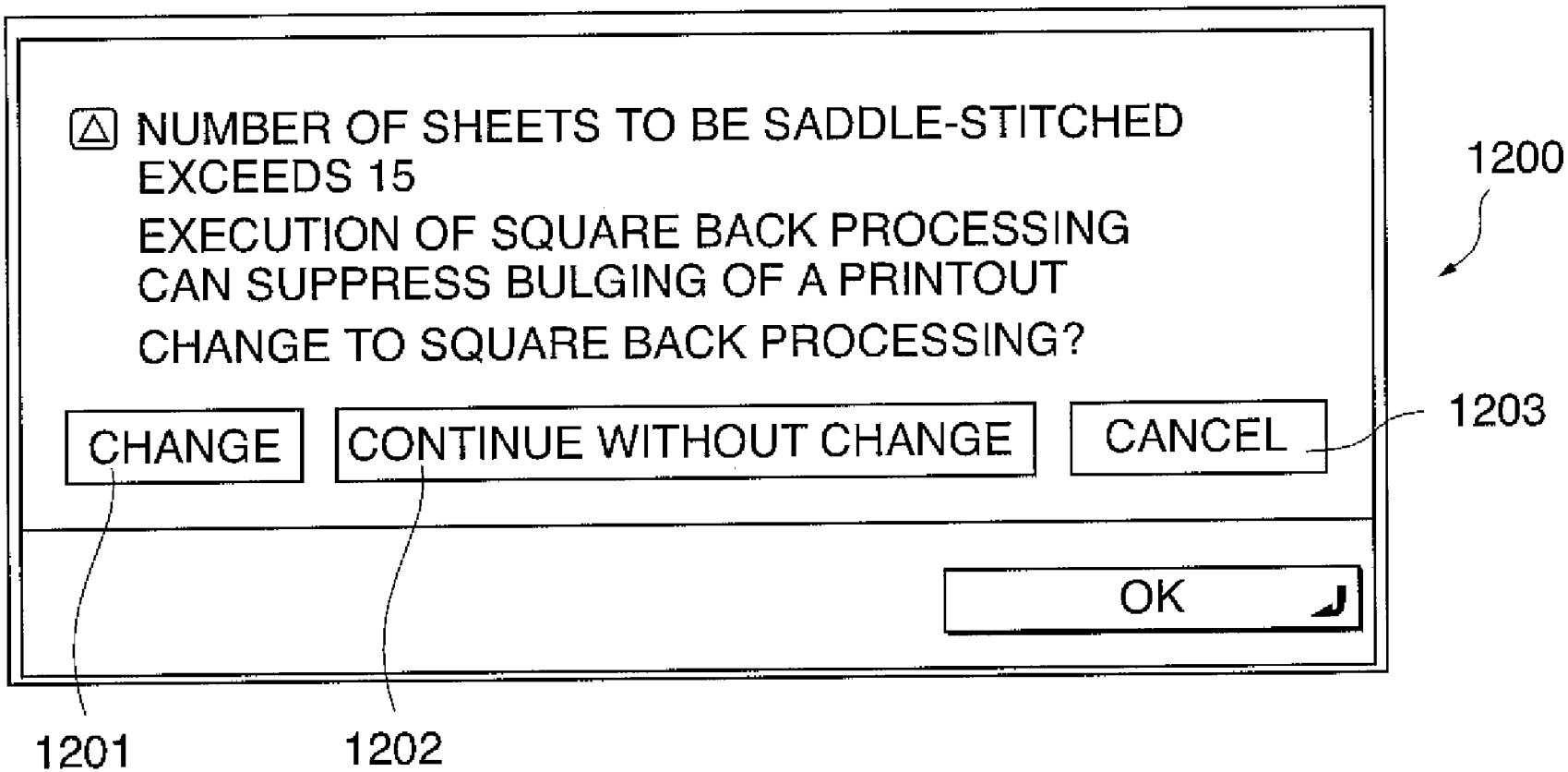
FIG. 12 is a view showing an example of a warning screen which is displayed according to the number of sheets of a saddle-stitched brochure so as to recommend a change to the square back processing.
Figure 13:
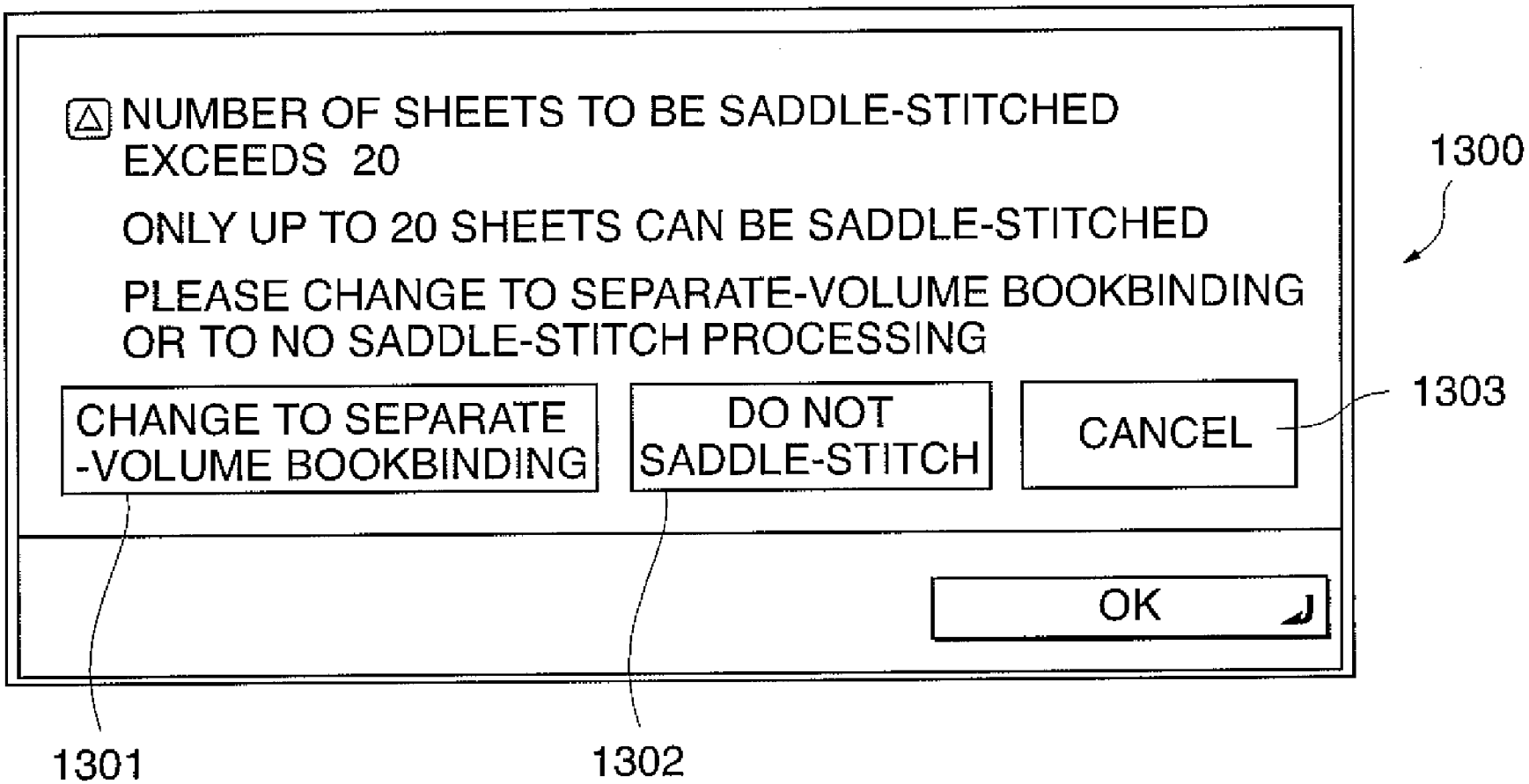
FIG. 13 is a view showing an example of a warning screen which is displayed according to the number of sheets of a saddle-stitched brochure so as to recommend a change to separate-volume bookbinding.

FIGS. 12 and 13 are views illustrating examples of warning screens which are caused to be displayed on the touch panel section 401 by the controller 205 when the controller 205 performs control such that creation of a saddle-stitched brochure of the second type is inhibited when settings of a job to be processed are configured.

It is assumed that the controller 205 determines that the number of sheets required to be printed as one set in a job to be subjected to saddle-stitch processing is smaller than the maximum allowable number in creating a saddle-stitched brochure of the first type but larger than the maximum allowable number in creating a saddle-stitched brochure of the second type. In the management table 2100 in FIG. 21, the maximum allowable number in creating a saddle-stitched brochure of the first type is set to 20, and the maximum allowable number in creating a saddle-stitched brochure of the second type is set to 15. Based on the above determination, the controller 205 causes the touch panel section 401 to display the warning screen 1200 shown in FIG. 12. Thus, the controller 205 performs control such that creation of a saddle-stitched brochure of the second type defective in stackability and/or print appearance can be prevented.

As described hereinbefore, a saddle-stitched brochure without a square back has a bulge when the number of sheets used therefor exceeds a certain sheet count. For this reason, in a case where the number of sheets required for saddle-stitch processing is larger than a predetermined number of sheets (e.g. 15 sheets), the warning screen 1200 shown in FIG. 12 is displayed to recommend execution of square back processing. It should be noted that a configuration may be adopted in which the operator is allowed to select a change to saddle-stitch processing including square back processing, or continuing the saddle-stitch processing without square back processing, or cancelling the saddle-stitch processing, as shown in FIG. 12. Of course, the printing system 1000 may be controlled by the controller 205 such that the job can be terminated (canceled) according to the above-described rules, as described hereinabove, without asking for operator's determination.

Let it be assumed, on the other hand, that the controller 205 determines that the number of sheets required to be printed as one set in a job to be subjected to saddle-stitch processing is larger than even the maximum allowable number in creating a saddle-stitched brochure of the first type (20 sheets in the management table 2100 in FIG. 21). Based on the above determination, the controller 205 causes the touch panel section 401 to display the warning screen 1300 shown in FIG. 13. It should be noted that the maximum allowable number in creating a saddle-stitched brochure of the first type, i.e. the maximum allowable number per volume in square back processing corresponds to the maximum allowable number in saddle-stitch processing by the saddle stitcher 28. This is because the number of sheets allowed for saddle-stitch processing has an upper limit dependent on the apparatus, and the upper limit is set in view of occurrence of a trouble due to mechanical reasons. Therefore, by setting the maximum allowable number per volume in square back processing to the maximum allowable number in saddle-stitch processing by the saddle stitcher 28, it is also possible to prevent occurrence of the mechanical trouble.

A configuration may be adopted which allows the operator to input an instruction for changing the current settings to settings for separate-volume bookbinding and executing saddle-stitch processing, an instruction for changing the current setting to settings for printout without saddle-stitch processing, or an instruction for canceling the job. This enables the controller 205 to respond to an instruction from the operator e.g. via the warning screen 1300 and cause the printing system 1000 to perform the above-described separate-volume bookbinding of a saddle-stitched brochure of the second type. Of course, the printing system 1000 may be controlled by the controller 205 such that the job can be canceled according to the above-described rules, as described hereinabove, without asking for operator's determination.

Figure 15A:
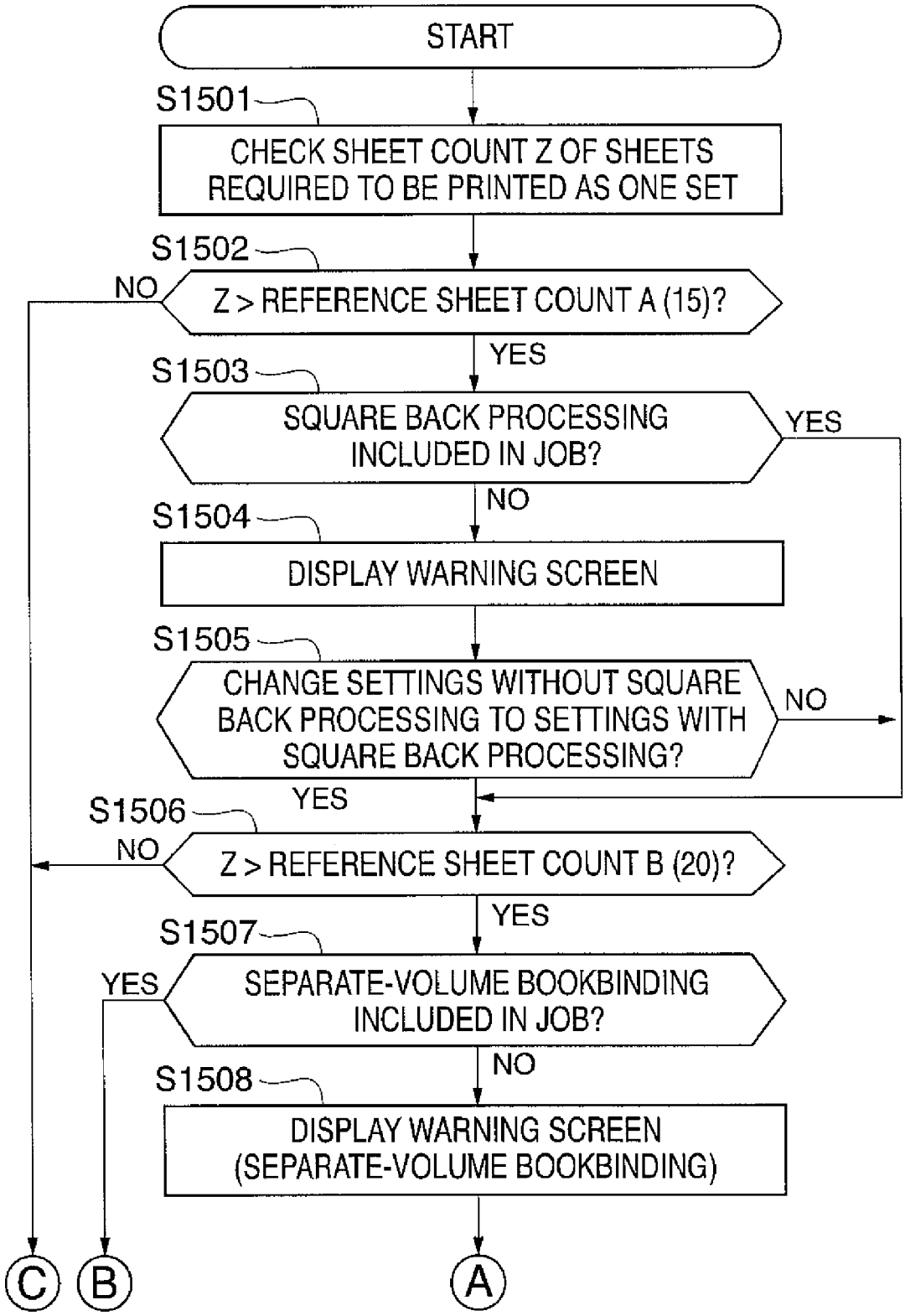
FIG. 15A and FIG. 15B are flowcharts of a first saddle-stitch printing restriction process which is executed when the number of sheets to be processed in saddle-stitch processing (including square back processing) is large.
Figure 15B:
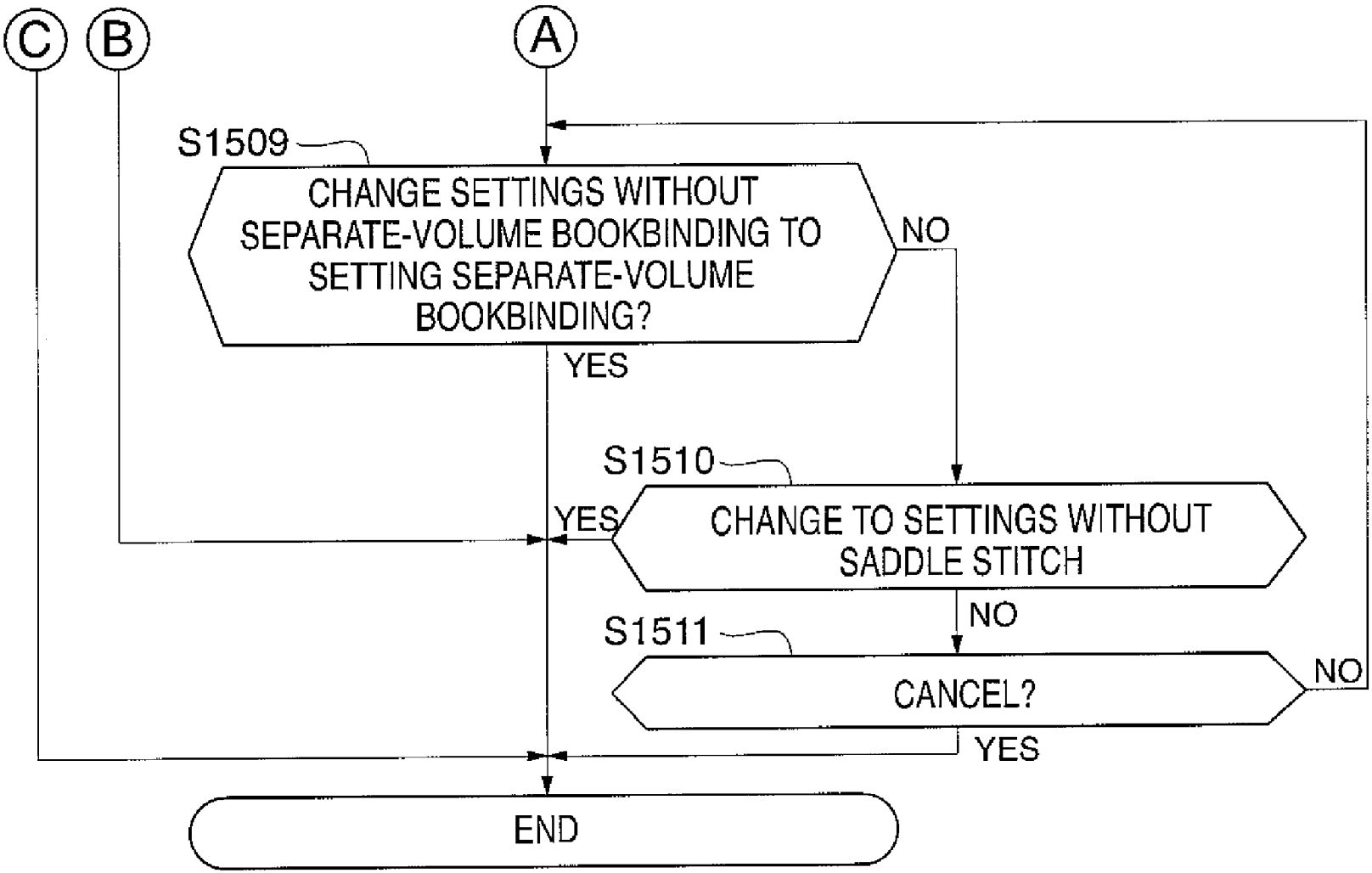

Next, with reference to FIG. 15A and FIG. 15B, descriptions will be given of a first saddle-stitch printing restriction process for restricting creation of a saddle-stitched brochure of the second type, which is executed by the controller 205, based on the first control as well as the second control executed according to the rules described in the management table 2100 in FIG. 21, in the timing of execution of the step S1403 in FIG. 14.

First, the controller 205 checks the sheet count Z of sheets required to be printed as one set for a saddle-stitch job, based on the number of all pages of print data for the job, which was stored in the HDD 209 in the step S1403 in FIG. 14 (S1501).

Next, the controller 205 performs comparison between the sheet count Z and a reference sheet count A (15 in the present example) (S1502). The reference sheet count A corresponds to the maximum allowable number per volume for creating a saddle-stitched brochure of the second type. If the sheet count Z is not larger than the reference sheet count A, the answer to the question of the step S1502 becomes negative (NO), and hence the present process is terminated. On the other hand, if the sheet count Z is larger than the reference sheet count A, the answer to the question of the step S1502 becomes affirmative (YES).

It should be noted that when the answer to the question of the step S1502 is negative (NO), the present process is terminated, but the processing for the saddle-stitch job is continuously carried out. For example, upon determination in the step S1502, the controller 205 permits creation of a saddle-stitched brochure of the second type for the job. Then, if the job is one designated by the operator in the step S1402 via the saddle-stitch job configuration screen 1100 to create a saddle-stitched brochure without a square back, upon termination of the FIG. 15A and FIG. 15B process, the process immediately proceeds to the step S1405 in FIG. 14. Then, the controller 205 executes the steps S1406, S1407, and S1408 as required. Thus, a saddle-stitched brochure of the second type based on the job is created by the printing system 1000.

Let it be assumed, on the other hand, that a job in which the answer to the question of the step S1502 is negative (NO) is one designated by the operator via the saddle-stitch job configuration screen 1100 in FIG. 11 to create a saddle-stitched brochure with a square back. In this case, the processing for the saddle-stitch job proceeds to the first control for controlling whether to permit or inhibit creation of a saddle-stitched brochure of the first type. In the illustrated example, the processing for the saddle-stitch job proceeds to a process described hereinafter with reference to FIG. 18 or FIG. 20.

If the answer to the question of the step S1502 is affirmative (YES) (i.e. if the sheet count Z is larger than the maximum allowable number in creating a saddle-stitched brochure of the second type), the present process proceeds to a step S1503. In the step S1503, the controller 205 determines, based on the processing conditions received from the operator via the saddle-stitch job configuration screen 1100 in FIG. 11 in the step S1402, whether or not the saddle-stitch job is designated as one including square back processing (i.e. a first-type job). If it is determined that the job does not include square back processing, i.e. if the answer to the question of the step S1503 is negative (NO), the process proceeds to a step S1504, wherein the controller 205 causes the touch panel section 401 to display the warning screen 1200 in FIG. 12. Thus, the controller 205 performs control such that the printing system 1000 is inhibited from creating a saddle-stitched brochure of the second type for the job.

Then, if a "Change" button 1201 appearing in FIG. 12 is pressed by the operator, the controller 205 performs control such that the associated setting of the job is changed to a setting for executing square back processing (S1505). Thus, the printing system 1000 is permitted to create a saddle-stitched brochure of the first type for the job. On the other hand, if a "Continue without change" button 1202 is pressed, the processing is continued without any change. It should be noted that a configuration may be adopted in which on condition that the answer to the question of the step S1502 is affirmative (YES) and the answer to the question of the step S1503 is negative (NO), the printing system 1000 is unexceptionally inhibited from creating a saddle-stitched brochure of the second type for the job.

On the other hand, if it is determined in the step S1503 that the saddle-stitch job is designated as one including square back processing, the process proceeds from the step S1503 to a step S1506.

In the step S1506, the controller 205 performs comparison between the sheet count Z and a predetermined reference sheet count B (20 sheets in the present example) different from the reference sheet count A. The reference sheet count B corresponds to the maximum allowable number per volume in creating a saddle-stitched brochure of the first type. If the sheet count Z is not larger than the reference sheet count B, the answer to the question of the step S1506 becomes negative (NO), and hence the present process in FIG. 15A and FIG. 15B are terminated. It should be noted that cases where the answer to the question of the step S1506 becomes negative (NO) include a case where the sheet count Z is not less than 15 and not more than 20, for example. In this case, the controller 205 permits execution of square back processing for the job, and then gives a negative answer to the question of the step S1506, followed by terminating the present process in FIG. 15A and FIG. 15B. Thereafter, the processing for the saddle-stitch job proceeds to the step S1405 in FIG. 14. Then, the controller 205 executes the steps S1406, S1407, and S1408 as required. Thus, a saddle-stitched brochure of the first type is caused to be created by the printing system 1000 in the job. On the other hand, if the sheet count Z is larger than the reference sheet count B, i.e. if the answer to the question of the step S1506 is affirmative (YES), the process proceeds to a step S1507.

In the step S1507, the controller 205 determines whether or not the settings of the job are configured by the operator such that execution of separate-volume bookbinding is permitted. If the setting for separate-volume bookbinding is not provided, i.e. if the answer to the question of the step S1507 is negative (NO), the controller 205 causes the touch panel section 401 to display the separate-volume bookbinding-related warning screen 1300 in FIG. 13 (S1508). Then, if a "Change to separate-volume bookbinding" button 1301 appearing in FIG. 13 is pressed, the associated setting of the job is changed to the setting for separate-volume bookbinding (S1509), and then print processing is started. On the other hand, without pressing the "Change to separate-volume bookbinding" button 1301, if a "Do not saddle-stitch" button 1302 is pressed in a step S1510, the setting for saddle-stitch processing is canceled, and then print processing is started. When a "Cancel" button 1203 or 1303 is pressed, the job is canceled, followed by terminating the present process (S1511).

Although in the present embodiment, the warning screens are displayed to recommend the operator to change settings, it is also possible to automatically change the settings without warning and then perform print processing.

As described above, the printing system 1000 is not only configured to support [Control 1] to [Control 16] described hereinbefore, but also may be configured to support the process described hereinabove with reference to FIG. 14. With the configuration, in the case of executing print processing for a job including saddle-stitch processing, when the number of sheets required for the job is larger than a predetermined number of sheets, it is possible to display the warning screen and at the same time change the current setting to a setting for saddle-stitch processing including square back processing. This makes it possible to prevent a printout from being spoiled due to collapse of the stacked sheets of the printout. Next, in view of the above-mentioned points, a description will be given of an example (more detailed example) of the application of the first control executed by the controller 205 together with the second control.

First, necessity of restriction of creation of a saddle-stitched brochure of the first type, which is practiced based on the aforementioned first control will be described with reference to FIGS. 16A and 16B.

Figure 16A:
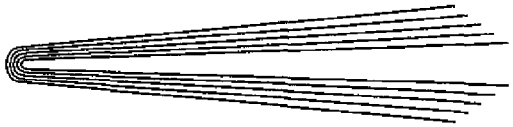
FIG. 16A is a cross-sectional view of an example of a saddle-stitched brochure without a square back.
Figure 16B:
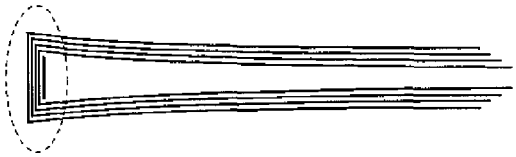
FIG. 16B is a cross-sectional view of an example of a saddle-stitched brochure with a square back.

FIGS. 16A and 16B are views useful in explaining the difference between a saddle-stitched brochure subjected to square back processing and a saddle-stitched brochure not subjected to square back processing in a case where the number of sheets used as one set for creating a saddle-stitched brochure is small. FIG. 16A is a cross-sectional view of an example of the saddle-stitched brochure not subjected to square back processing, while FIG. 16B is a cross-sectional view of an example of the saddle-stitched brochure subjected to square back processing.

Figure 17:
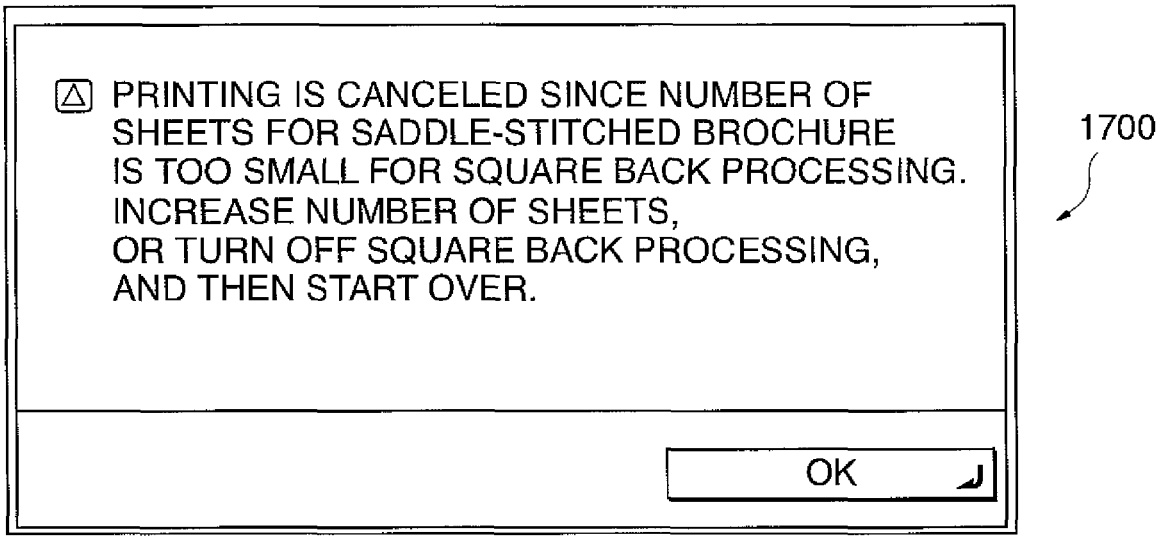
FIG. 17 is a view illustrating an example of a warning screen which is displayed when the number of sheets to be processed in saddle-stitch processing (including square back processing) is small.

As shown in FIG. 16A, in a case where the number of sheets required to be printed as one set is small, even when saddle-stitch processing without square back processing is executed, the problem described hereinabove with reference to FIG. 10C is not caused, and therefore it is possible to create a saddle-stitched brochure having no problem in print appearance and stackability. On the other hand, when square back processing is executed in a case where the number of sheets required to be printed as one set is small, the back of the printout can be crushed as shown in FIG. 16B, or wrinkled or broken. Further, this causes bulging of the back, which deteriorates the stackability of the printout. Thus, if creation of a saddle-stitched brochure of the first type is inadvertently created even in a case where the number of sheets required to be printed as one set is very small, the above-mentioned troubles occur after all. That is, a saddle-stitched brochure defective in print appearance and stackability is created unintentionally. To solve this problem, in the present embodiment, the printing system is configured such that occurrence of the troubles can be suppressed by the aforementioned first control. In view of this point, an example of the application of the first control will be described below. In this example, control is performed such that the advantage of a saddle-stitched brochure without a square back can be favorably utilized by restricting creation of a saddle-stitched brochure with a square back. This control will be described with reference to FIGS. 17 and 19.

For example, assume a case where a job designated by the operator as one in which saddle-stitch processing including square back processing is to be performed requires a number of sheets less in number than a predetermined number of sheets (5 sheets in the present example) to be printed as one set. It should be noted that this predetermined number of sheets corresponds to the minimum allowable number of sheets per volume (5 sheets in the example shown in FIG. 21) in creating a saddle-stitched brochure of the first type. If the controller 205 determines that this case applies to a job, the controller 205 causes the touch panel section 401 to display a warning screen 1700 shown in FIG. 17 or a warning screen 1900 shown in FIG. 19.

The controller 205 uses the warning screen 1700 to warn that the number of sheets is too small for execution of square back processing, and cancels the stating of print processing in the job. In this case, the operator needs to configure the job such that the number of sheets is increased and the square back processing is not be executed (is turned off), and then issue a print job again. On the other hand, the warning screen 1900 is used to display a warning message and recommend the operator to change the current settings. In this case, the operator can restart printing by selecting between "Turn off square back processing" and "No execution of saddle stitching". Alternatively, the operator can cancel the job. Preferably, either the warning screen 1700 or the warning screen 1900 is used.

with this configuration, control is performed such that creation of a saddle-stitched brochure of the first type defective in stackability and/or print appearance is prevented. As described hereinbefore, a saddle-stitched brochure without a square back has a bulge when the number of sheets used therefor exceeds a certain sheet count. Therefore, when the number of sheets to be used for saddle-stitch processing exceeds a predetermined number of sheets (e.g. 15 sheets), the configuration in which the warning screen 1700 or the warning screen 1900 is displayed to ask the operator for determination may not be adopted. For example, the printing system 1000 may be controlled by the controller 205 such that the job is terminated (canceled) according to the rules in FIG. 21 or 22 without asking for the operator's determination.

Next, with reference to FIGS. 18 and 20, a description will be given of second and third saddle-stitch printing restriction processes for restricting creation of a saddle-stitched brochure of the first type, each of which is executed by the controller 205, based on the second control as well as the first control executed according to the rules described in the management table 2100 in FIG. 21, in the timing of execution of the step S1403 in FIG. 14. It should be noted that FIG. 20 corresponds to a variation of FIG. 18.

Figure 18:
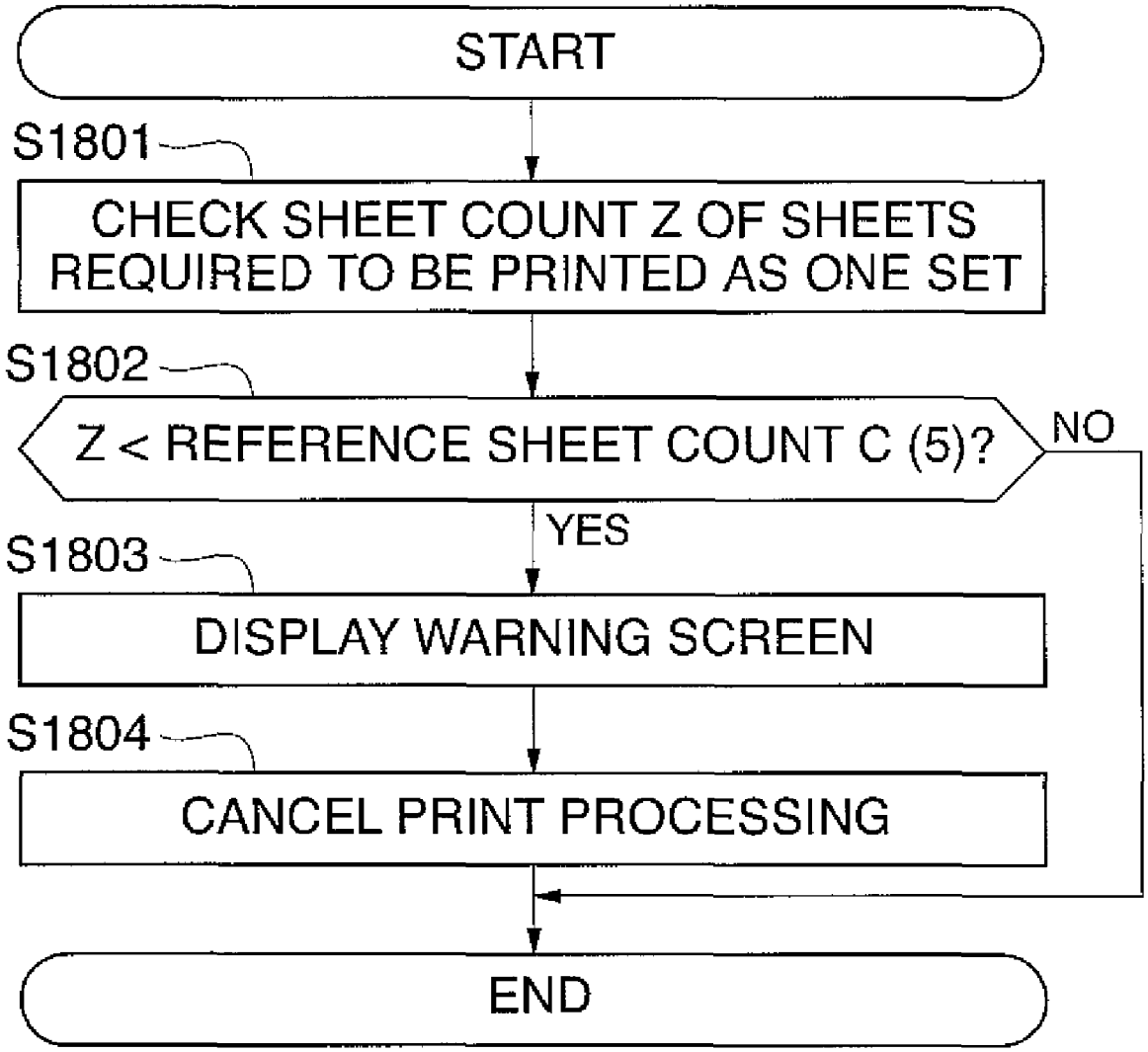
FIG. 18 is a flowchart of a second saddle-stitch printing restriction process which is executed when the number of sheets to be processed in saddle-stitch processing (including square back processing) is small.
Figure 20:
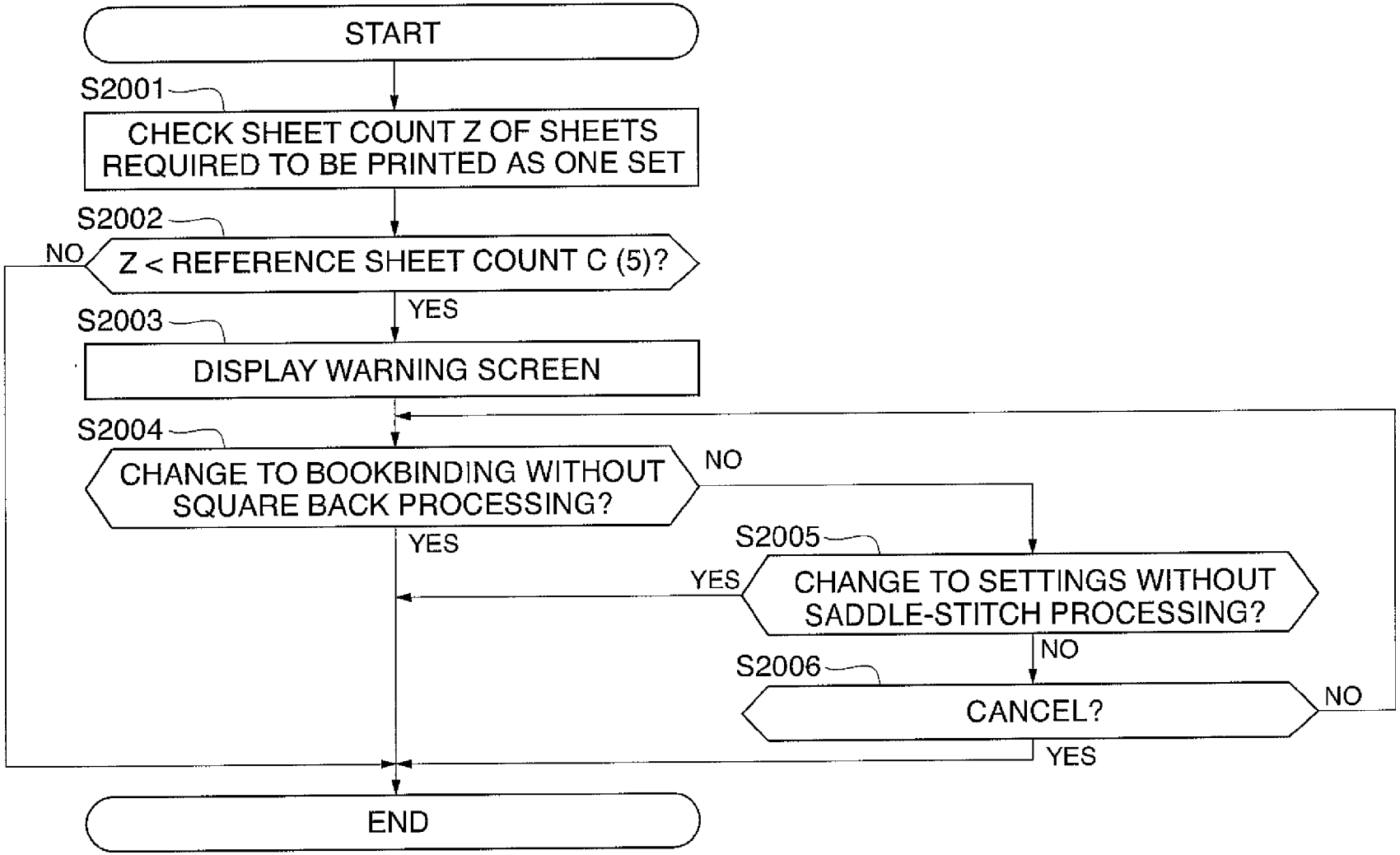
FIG. 20 is a flowchart of a process which is executed for changing a setting when the number of sheets to be processed in saddle-stitch processing (including square back processing) is small.

Although in the present example, the second saddle-stitch printing restriction process in FIG. 18 and the third saddle-stitch printing restriction process in FIG. 20 will be both described, only one of them may be employed. In the present embodiment, the second saddle-stitch printing restriction process in FIG. 18 is executed following the step S1502, for a job in which the answer to the question of the step S1502 described hereinabove with reference to FIG. 15A and FIG. 15B are negative (NO). Similarly, the third saddle-stitch printing restriction process in FIG. 20 is executed following the step S1502, for job in which the answer to the question of the step S1502 described hereinbefore with reference to FIG. 15A and FIG. 15B are negative (NO). However, this is not limitative, but the printing system may be configured differently. For example, the second saddle-stitch printing restriction process in FIG. 18 or the third saddle-stitch printing restriction process in FIG. 20 may be executed e.g. prior to the first saddle-stitch printing restriction process in FIG. 15A and FIG. 15B. Any configuration may be adopted in which both the first control and the second control are executed for a job to be processed.

First in a step S1801, the controller 205 checks the sheet count Z of the sheets required to be printed as one set for a job in which the answer to the question of the step S1502 is negative (NO). It should be noted that since the same processing as this is executed in the step S1501 in FIG. 15A and FIG. 15B, the step S1801 may be omitted.

Then, in a step S1802, the controller 205 performs comparison between the sheet count Z and a predetermined reference sheet count C different from the aforementioned reference sheet counts A and B. The present reference sheet count C corresponds to the minimum allowable number of sheets per volume in creating a saddle-stitched brochure of the first type (5 sheets in the example of FIG. 21). If the sheet count Z is not smaller than the reference sheet count C, the answer to the question of the step S1802 becomes negative (NO), and hence the present process in FIG. 18 is terminated. It should be noted that the answer to the question of the step S1802 becomes negative (NO) at least when the sheet count Z is not less than 5. Further, in the present embodiment, since it is already determined in the step S1502 in FIG. 15S and FIG. 15B that the sheet count Z is not larger than 15 (sheets), the job in which the answer to the question of the step S1802 is negative (NO) corresponds to a job in which the sheet count Z is not less than 5 and not more than 15. If the answer to the question of the step S1802 is negative (NO), the controller 205 permits execution of square back processing in the job, followed by terminating the present process in FIG. 18. Thereafter, the processing of the job proceeds to the step S1405 in FIG. 14. Then, the controller 205 executes the steps S1406, S1407, and S1408 as required. At this time, if saddle-stitch processing including square back processing has been designated for the job by the operator via the screen in FIG. 11 in the step S1402, square back processing is executed in the steps S1406. Thus, the controller 205 causes the printing system 1000 to create a saddle-stitched brochure of the first type based on the job. On the other hand, if saddle-stitch processing without square back processing has been designated for the job by the operator via the screen in FIG. 11 in the step S1402, the square back processing in the step S1406 is skipped. Thus, the controller 205 causes the printing system 1000 to create a saddle-stitched brochure of the second type based on the job.

On the other hand, if it is determined in the step S1802 that the sheet count Z is smaller than the reference sheet count C, i.e. if the answer to the question of the step S1802 is affirmative (YES), the controller 205 inhibits execution of square back processing (i.e. creation of a saddle-stitched brochure of the first type) for the job to be processed. Then, in a step S1803, the controller 205 causes the touch panel section 401 to display the warning screen 1700.

It should be noted that the printing system 1000 according to the present embodiment is configured, as described hereinbefore, to be capable of inhibiting creation of a saddle-stitched brochure of the first type in a job and print processing for the job at the same time. In the present embodiment, as a control operation corresponding to this configuration, print processing required for the job in which the answer to the question of the step S1802 is affirmative (YES), i.e. the job in which creation of a saddle-stitched brochure of the first type is inhibited, is canceled in a step S1804 so as to prevent execution of the print processing. As a consequence, the processing of the job is immediately terminated without proceeding to the step S1405 in FIG. 14.

Figure 19:
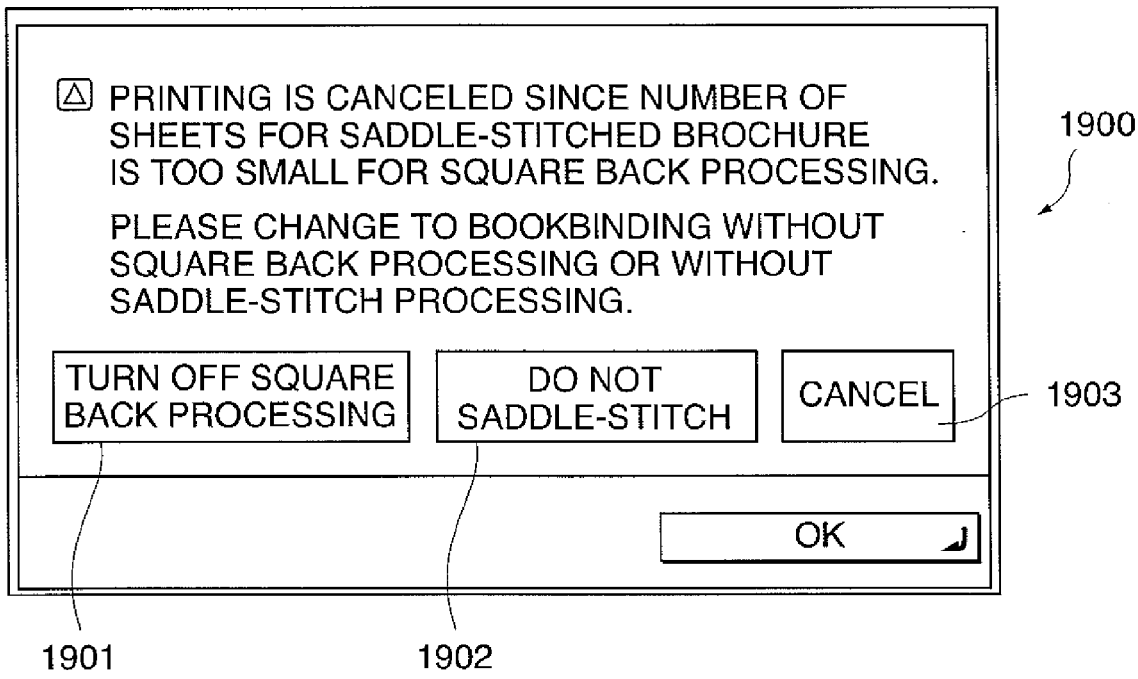
FIG. 19 is a view illustrating an example of a warning screen displayed to recommend a change to saddle-stitch processing without square back processing when the number of sheets to be processed in saddle-stitch processing (including square back processing) is small.

In the example illustrated in FIG. 18, when the sheet count Z is smaller than the reference sheet count C (5 sheets in the example in FIG. 21), the processing of the job is unexceptionally canceled. However, a configuration may be adopted in which a request for change to different processing can be accepted from the operator via the UI on which the screen 1900 illustrated in FIG. 19 is displayed. This will be described with reference to the third saddle-stitch printing restriction process in FIG. 20.

First in a step S2001, the controller 205 checks the sheet count Z of the sheets required to be printed as one set as to a job in which the answer to the question of the step S1502 is negative (NO). It should be noted that since the same processing as this is executed in the step S1501 in FIG. 15A and FIG. 15B, the step S2001 may be omitted.

Then, in a step S2002, the controller 205 performs comparison between the sheet count Z and the reference sheet count C (5 sheets in the example in FIG. 21). If the sheet count Z is not smaller than the reference sheet count C, the answer to the question of the step S2002 becomes negative (NO), and hence the present process is terminated.

It should be noted that the answer to the question of the step S2002 becomes negative (NO) at least when the sheet count Z is not less than 5. Further, in the present embodiment, since it is already determined in the step S1502 in FIG. 15A and FIG. 15B with reference to which the second control is described that the sheet count Z is not larger than 15, the job in which the answer to the question of the step S2002 is negative (NO) corresponds to a job in which the sheet count Z is not less than 5 and not more than 15. If the answer to the question of the step S2002 is negative (NO), the controller 205 permits execution of square back processing in the job, followed by terminating the present process in FIG. 18. Thereafter, the processing of the job proceeds to the step S1405. Then, the controller 205 executes the steps S1406, S1407, and S1408 as required. At this time, if saddle-stitch processing including square back processing has been designated for the job by the operator via the screen 1100 in FIG. 11 in the step S1402, square back processing is executed in the steps S1406. Thus, the controller 205 causes the printing system 1000 to create a saddle-stitched brochure of the first type in the job. On the other hand, if saddle-stitch processing without square back processing has been designated for the job by the operator via the screen 1100 in FIG. 11 in the step S1402, the square back processing in the step S1406 is skipped. Thus, the controller 205 causes the printing system 1000 to create a saddle-stitched brochure of the second type in the job to be processed.

On the other hand, if it is determined in the step S2002 that the sheet count Z is smaller than the reference sheet count C, i.e. if the answer to the question of the step S2002 is affirmative (YES), the controller 205 inhibits execution of square back processing (i.e. creation of a saddle-stitched brochure of the first type) in the job to be processed. Then, in a step S2003, the controller 205 causes the touch panel section 401 to display the warning screen 1900 illustrated in FIG. 19.

Let it be assumed that a "Turn off square back processing" button 1901 on the warning screen 1900 is pressed by the operator. In this case, the controller 205 gives an affirmative answer to the question of a step S2004, and controls the printing system 1000 to create a saddle-stitched brochure of the second type in the job to be processed, without creating a saddle-stitched brochure of the first type. In this case, the third saddle-stitch printing restriction process in FIG. 20 is terminated, but the processing of the job proceeds to the step S1405 in FIG. 14. Then, after execution of the step S1406, the controller 205 skips the square back processing in the step S1407, and executes the step S1408. Thus, the controller 205 causes the printing system 1000 to create a saddle-stitched brochure of the second type in the job to be processed.

Let it be assumed, on the other hand, that a "Do not saddle-stitch" button 1902 on the warning screen 1900 is pressed by the operator. In this case, the controller 205 gives a negative answer (NO) to the question of the step S2004 and an affirmative answer (YES) to the question of a step S2005. In this case as well, creation of a saddle-stitched brochure of the first type in the job is inhibited. In this case, the controller 205 does not permit creation of a saddle-stitched brochure of the second type in the job, either, but performs control such that print processing which does not require saddle-stitch processing will be executed. More specifically, in this case, the controller 205 treats the job to be processed not as the saddle-stitch job, but as another type of job, such as the aforementioned stacker job or the aforementioned glue binding job. Therefore, in this case as well, after termination of the third saddle-stitch printing restriction process in FIG. 20, the process for the job proceeds to the step S1405 in FIG. 14, but the saddle-stitch processing in the step S1406 and the square back processing in S1407 are both skipped. Thus, the controller 205 causes the printing system 1000 to create a printout different in appearance from a saddle-stitched brochure in the job to be processed.

Let it be assumed, on the other hand, that a "Cancel" button 1903 on the warning screen 1900 is pressed by the operator. In this case, the controller 205 gives the negative answer (NO) to the question of the step S2004, a negative answer (NO) to the question of the step S2005, and an affirmative answer (YES) to the question of a step S2006. In this case, the processing of the job to be processed is immediately terminated without returning to the step S1405 in FIG. 14. Thus, the controller 205 can cancel the processing of the job without executing print processing in the job.

As described above, the printing system 1000 is not only configured to support [Control 1] to [Control 16] described hereinbefore, but also may be configured to support the processes described by way of example with reference to FIGS. 18 and 20. With the configurations, in the case of executing print processing for a job designated for saddle-stitch processing with square back processing, when the number of sheets required for the job is less than a predetermined number of sheets, it is possible to display a warning message and recommend the operator to increase the number of sheets, change to a setting for saddle-stitch processing without square back processing, or cancel printing. This makes it possible to prevent a printout from being crushed or spoiled due to collapse of the stacked sheets of the printout.

The printing system 1000 according to the present embodiment is configured to be capable of executing both the first control and the second control. However, this is not limitative, but it is possible to make various changes and modifications. For example, the printing apparatus and/or the printing system is configured to be capable of executing only one of the first control and the second control. Further, the various kinds of processing and/or control operations, described above, may be executed by a single unit, or alternatively they may be shared by a plurality of units so that the units cooperate to execute them. Furthermore, the aforementioned sheet processing apparatuses may be used as optional equipment for the printing apparatus or provided as standard equipment for the same. A configuration may be adopted in which a unit for performing control corresponding to the control performed by the controller 205 described above is incorporated in an apparatus other than the printing apparatus 100, such as a sheet processing apparatus, or a host computer or an external information processing apparatus like a portable terminal apparatus, which is capable of performing data communication with the printing apparatus via the network. This enables the apparatus to function by itself as a system corresponding to the printing system 1000 according to the present embodiment. Although in the above configurations, the controller 205 functions as a unit for performing a plurality of determinations and control operations for square back processing, this is not limitative. For example, some of the determinations and control operations to be performed by the controller 205 in the above-described embodiment may be performed by another unit. Thus, the present invention can be applied not only to a case where an apparatus and/or a system is controlled by a single CPU, but also to a case where a plurality of CPUs cooperate to control an apparatus and/or a system. Further, although in the present embodiment, two-position stitching using two staples is performed for saddle-stitch processing, this is not limitative, either. For example, the fold of a sheet bundle folded in half may be stitched at three locations using three staples, i.e. three-position stitching may be performed. Further, stitching members other than staples may be used for saddle-stitch processing. For example, a thread may be used to stitch the fold of a sheet bundle folded in half.

As described above, the printing system 1000 according to the present embodiment is provided with the various configurations. Thus, the printing system is constructed to be capable of performing square back processing, and therefore it is possible to suppress occurrence of the trouble that a saddle-stitched brochure defective in the appearance of a trimmed edge and/or print appearance is inadvertently created. For example, it is possible to prevent a saddle-stitched brochure without a square back from being inadvertently created with a back thereof very bulging, i.e. with bad appearance and/or stackability. Further, it is possible to prevent a saddle-stitched brochure with a square back from being inadvertently created with a back thereof very much crushed, wrinkled, or broken, i.e. with bad appearance and/or stackability.

It is to be understood that the present invention may also be accomplished by supplying a system or an apparatus with a storage medium in which a program code of software, which realizes the functions of the above described embodiment, is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, an optical disk, such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

Further, it is to be understood that the functions of either of the above-described embodiments may be accomplished not only by executing the program code read out by a computer, but also by causing an OS (operating system) or the like which operates on the computer to perform a part or all of the actual operations based on instructions of the program code. In this case, the program code is supplied from a storage medium in which the program code is stored, or is supplied by downloading directly from another computer, a database, or the like, not shown, connected to the Internet, a commercial network, a local area network, or the like.

Although in the above embodiment, the electrophotographic printing is adopted as the printing method executed by the complex apparatus, there is no intention to limit the invention to this. For example, the present invention may be applied to a variety of printing methods such as ink-jet printing, thermal transfer printing, thermal printing, electrostatic printing, and discharge breakdown printing.

The form of the program may be an object code, a program code executed by an interpreter, or script data supplied to an OS (Operating System).

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2007-213843 filed Aug. 20, 2007, which is hereby incorporated by reference herein in its entirety.

What is claimed is:

1. A bookbinding apparatus comprising:

a folding unit adapted to perform folding processing on a sheet bundle including a plurality of sheets;

a working unit adapted to perform working processing for forming a flat surface on a back of the sheet bundle on which the folding processing is performed; and a control unit adapted to, in a case where the working processing is selected by a user not to be performed, permit the working processing not to be performed on the sheet bundle on which the folding processing is performed when the number of sheets included in the sheet bundle on which the folding processing is performed is not greater than a predetermined number of sheets, but to cause a display unit to display a warning screen when the number of sheets included in the sheet bundle on which the folding processing is performed is greater than the predetermined number of sheets.

2. The bookbinding apparatus according to claim 1, wherein the warning screen is adapted to be changed in setting by the user such that the working processing is performed.

3. The bookbinding apparatus according to claim 1, further comprising a printing unit adapted to perform printing processing on a sheet, wherein the folding unit is adapted to perform the folding processing on one set of sheets subjected to the printing processing.

4. The bookbinding apparatus according to claim 1, wherein the folding processing comprises saddle-stitch processing.

5. The bookbinding apparatus according to claim 1, further comprising a selecting unit adapted to select whether or not the working processing is performed, based on an instruction of the user.

6. The bookbinding apparatus according to claim 1, wherein the predetermined number of sheets is determined based on a type of the sheets.

7. A bookbinding apparatus comprising:

a folding unit adapted to perform folding processing on a sheet bundle including a plurality of sheets;

a working unit adapted to perform working processing for forming a flat surface on a back of the sheet bundle on which the folding processing is performed; and a control unit adapted to, in a case where the working processing is selected by a user not to be performed, permit the working processing not to be performed on the sheet bundle on which the folding processing is performed when the number of sheets included in the sheet bundle on which the folding processing is performed is not less than a predetermined number of sheets, but to cause a display unit to display a warning screen when the number of sheets included in the sheet bundle on which the folding processing is performed is less than the predetermined number of sheets.

8. The bookbinding apparatus according to claim 7, wherein the warning screen is adapted to be changed in setting by the user such that the working processing is not performed.

9. The bookbinding apparatus according to claim 7 further comprising a printing unit adapted to perform printing processing on a sheet, wherein the folding unit is adapted to perform the folding processing on one set of sheets subjected to the printing processing.

10. The bookbinding apparatus according to claim 7, wherein the folding processing comprises saddle-stitch processing.

11. The bookbinding apparatus according to claim 7, further comprising a selecting unit adapted to select whether or not the working processing is performed, based on an instruction of the user.

12. The bookbinding apparatus according to claim 7, wherein the predetermined number of sheets is determined based on a type of the sheets.

13. A bookbinding method executed by a bookbinding apparatus, the method comprising the steps of:

a folding step of performing folding processing on a sheet bundle including a plurality of sheets;

a working step of performing working processing for forming a flat surface on a back of the sheet bundle on which the folding processing is performed; and a control step of, in a case where the working processing is selected by a user not to be performed, permitting the working processing not to be performed on the sheet bundle on which the folding processing is performed when the number of sheets included in the sheet bundle on which the folding processing is performed is not greater than a predetermined number of sheets, but causing a display unit to display a warning screen when the number of sheets included in the sheet bundle on which the folding processing is performed is greater than the predetermined number of sheets.

14. A bookbinding method executed by a bookbinding apparatus, the method comprising the steps of:

a folding step of performing folding processing on a sheet bundle including a plurality of sheets;

a working step of performing working processing for forming a flat surface on a back of the sheet bundle on which the folding processing is performed; and a control step of, in a case where the working processing is selected by a user not to be performed, permitting the working processing not to be performed on the sheet bundle on which the folding processing is performed when the number of sheets included in the sheet bundle on which the folding processing is performed is not less than a predetermined number of sheets, but causing a display unit to display a warning screen when the number of sheets included in the sheet bundle on which the folding processing is performed is less than the predetermined number of sheets.

15. A non-transitory computer-readable storage medium storing a program adapted to be executed at least by a computer in a bookbinding apparatus, the program comprising:

a folding module adapted to cause performance of folding processing on a sheet bundle including a plurality of sheets;

a working module adapted to cause performance of working processing for forming a flat surface on a back of the sheet bundle on which the folding processing is performed; and a control module adapted to, in a case where the working processing is selected by a user not to be performed, permit the working processing not to be performed on the sheet bundle on which the folding processing is performed when the number of sheets included in the sheet bundle on which the folding processing is performed is not greater than a predetermined number of sheets, but to cause a display module to display a warning screen when the number of sheets included in the sheet bundle on which the folding processing is performed is greater than the predetermined number of sheets.

16. A non-transitory computer-readable storage medium storing a program adapted to be executed at least by a computer in a bookbinding apparatus, the program comprising:

a folding module adapted to cause performance of folding processing on a sheet bundle including a plurality of sheets;

a working module adapted to cause performance of working processing for forming a flat surface on a back of the sheet bundle on which the folding processing is performed; and a control module adapted to, in a case where the working processing is selected by a user not to be performed, permit the working processing not to be performed on the sheet bundle on which the folding processing is performed when the number of sheets included in the sheet bundle on which the folding processing is performed is not less than a predetermined number of sheets, but to cause a display module to display a warning screen when the number of sheets included in the sheet bundle on which the folding processing is performed is less than the predetermined number of sheets.

* * * * *